US007917067B2

(12) United States Patent
Takano et al.

(10) Patent No.: US 7,917,067 B2
(45) Date of Patent: Mar. 29, 2011

(54) MAGNETIC FIELD GENERATING MEMBER AND MANUFACTURING METHOD THEREOF, MAGNETIC PARTICLE SUPPORT BODY, IMAGE DEVELOPMENT DEVICE, PROCESS CARTRIDGE AND IMAGE FORMING APPARATUS

(75) Inventors: Yoshiyuki Takano, Hachioji (JP); Kyohta Koetsuka, Fujisawa (JP); Noriyuki Kamiya, Yamato (JP); Masayuki Ohsawa, Atsugi (JP); Mieko Terashima, Isehara (JP); Rei Suzuki, Atsugi (JP); Hiroya Abe, Yokohama (JP); Takashi Innami, Atsugi (JP); Tadaaki Hattori, Hadano (JP)

(73) Assignee: Ricoh Company, Ltd., Tokyo (JP)

( * ) Notice: Subject to any disclaimer, the term of this patent is extended or adjusted under 35 U.S.C. 154(b) by 158 days.

(21) Appl. No.: 12/346,142

(22) Filed: Dec. 30, 2008

(65) Prior Publication Data

US 2009/0175666 A1 Jul. 9, 2009

(30) Foreign Application Priority Data

Jan. 7, 2008 (JP) ..... 2008-000749

(51) Int. Cl.
*G03G 15/09* (2006.01)

(52) U.S. Cl. ..... 399/267; 399/277; 492/8; 492/18

(58) Field of Classification Search ..... 399/267, 399/277; 492/8, 18, 47
See application file for complete search history.

(56) References Cited

U.S. PATENT DOCUMENTS

| | | | | |
|---|---|---|---|---|
| 3,714,692 | A * | 2/1973 | Bray | 492/8 |
| 6,061,541 | A * | 5/2000 | Bessette | 399/277 |
| 2008/0003013 | A1 * | 1/2008 | Martin et al. | 399/109 |

FOREIGN PATENT DOCUMENTS

| | | |
|---|---|---|
| JP | 58-139409 | 8/1983 |
| JP | 5-142947 | 6/1993 |
| JP | 6-308834 | 11/1994 |
| JP | 8-123200 | 5/1996 |
| JP | 2000-243620 | 9/2000 |
| JP | 2000-269024 | 9/2000 |
| JP | 2002-278279 | 9/2002 |
| JP | 2002-278282 | 9/2002 |
| JP | 2003-163111 | 6/2003 |
| JP | 2006-259222 | 9/2006 |
| JP | 3989158 | 7/2007 |

* cited by examiner

*Primary Examiner* — David M Gray
*Assistant Examiner* — Barnabas T Fekete
(74) *Attorney, Agent, or Firm* — Oblon, Spivak, McClelland, Maier & Neustadt, L.L.P.

(57) ABSTRACT

A magnetic field generating member with high stiffness and small size, an image development device, a process cartridge and an image forming apparatus including the magnetic field generating member as well as a manufacturing method of the magnetic field generating member are provided where the magnetic field generating member includes a main body, a groove provided in the main body, an interposition member configured to be fitted in the groove of the main body and including a concave portion and a magnetic member as a long magnetic compact fixed into the concave portion of the interposition member.

16 Claims, 13 Drawing Sheets

(CONCAVE "R" SHAPED FLOOR PART)

(CONVEX "R" SHAPED FLOOR PART)

("V" LETTER SHAPED FLOOR PART)

(REVERSE "V" LETTER SHAPED FLOOR PART)

MAGNETIC FIELD GENERATING MEMBER AND MANUFACTURING METHOD THEREOF, MAGNETIC PARTICLE SUPPORT BODY, IMAGE DEVELOPMENT DEVICE, PROCESS CARTRIDGE AND IMAGE FORMING APPARATUS

PRIORITY CLAIM

This application claims priority from Japanese Patent Application No. 2008-000749, filed with the Japanese Patent Office on Jan. 7, 2008, the contents of which are incorporated herein by reference in their entirety.

BACKGROUND OF THE INVENTION

1. Field of the Invention

The present invention relates to a magnetic field generating member used in a copier, facsimile, printer or the like as well as a magnetic particle support body, an image development device, a process cartridge and an image forming apparatus. For example, the present invention relates to a magnetic particle support body that forms a toner image by image developing an electrostatic latent image on an electrostatic latent image support body using a developer agent constituted from toners and magnetic particles. The present invention also relates to a magnetic field generating member used in such a magnetic particle support body and an image development device that includes such a magnetic particle support body. In addition, the present invention relates to a process cartridge and an image forming apparatus having such an image development device.

2. Description of the Related Art

A variety of image development devices that form an image using a so called binary developer agent including toners and magnetic carriers (described as developer agent hereinbelow) are used in an image forming apparatus of a copier, a facsimile and a printer or the like. This kind of image development device delivers the developer agent to an image development area facing a photosensitive drum (that is, the electrostatic latent image support body) and includes an image development roller (that is, the magnetic particle support body) that forms a toner image by image developing the electrostatic latent image formed on the photosensitive drum using the delivered developer agent.

The image development roller includes a cylindrical shaped image development sleeve constituted from non-magnetic materials and a magnet roller (that is, the magnetic field generating member) held inside the image development sleeve that generates magnetic force so that the developer agent is spike erected on the surface of the image development sleeve. In the image development roller, magnetic carriers contained in the developer agent spike erect on the image development sleeve along the magnetic lines (magnetic force) generated by the magnet roller and toners become attached to the spike erected magnetic carriers, that is, the developer agent is spike erected.

In recent years, electronic copiers and printers are increasingly colorized. These color image forming apparatuses require an image development device generally corresponding to 4 colors (yellow, magenta, cyan and black). In order for these image forming apparatuses to become smaller sized, the image development device also needs to be down-sized, which naturally leads to the down-sizing of the image development roller used in the image development device.

A smaller sized image development roller is realized by a magnet roller of a smaller diameter. However, when the diameter of the magnet roller becomes smaller, the volume of the magnet is reduced and magnetic force generated by the magnet roller is impaired. Therefore, when image development is performed using an image development roller with the magnet roller of a smaller diameter, deteriorations in quality of development images become problematic. Propositions to solve this problem are made in JP 2000-243620A.

The main body part of a magnet roller proposed in JP 2000-243620A includes a cylindrical column-like shaped ferrite resin magnetic body and a rare-earth resin magnetized body fixed in a concave groove disposed along an axial direction of the cylindrical column-like body in the external circumference surface of the cylindrical column-like body. The main body part of this magnet roller is shaped by magnetic materials and includes the rare-earth resin magnetized body having high magnetic force so that a magnet roller of small diameter but high magnetic force can be obtained.

However, the main body part (including the axial part) of the magnet roller proposed in JP 2000-243620A is shaped by a ferrite resin magnetic body of an inferior strength. Furthermore, the concave groove is disposed in the external circumference surface of the main body part. Therefore, stiffness of the magnet roller becomes insufficient and the magnet roller is subject to easy flexure. Thereby deformation due to time lapse or warpage and deflection of the magnet roller or the like is inevitably generated at times. Therefore, magnetic force on the surface of the image development roller becomes non-uniform during image development operations so that irregularities are generated to the spike erections of the developer agent and quality of development images deteriorates problematically.

In addition, because of the flexure of the magnet roller due to insufficient stiffness, there is a possibility that the rare-earth resin magnetized body fixed to the magnet roller might be bent and damaged so that during usage of the magnet roller, malfunction of the image development device or the like is triggered and during storage of the magnet roller, defective products are yielded despite their not even being in-use. Therefore, reliability and product quality deteriorates problematically.

SUMMARY OF THE INVENTION

The present invention is made to solve the above-described problems. An object of the present invention is to provide a magnetic field generating member of high stiffness and small size, an image development device including such a magnetic field generating member, a process cartridge and an image forming apparatus as well as the manufacturing method of the magnetic field generating member.

To accomplish the above object, the present invention includes a magnetic field generating member having a cylindrical column-like shaped main body part, a groove of the main body part with a rectangular shaped cross-sectional surface disposed in the external circumference surface of the cylindrical column-like shaped main body part along an axial direction and a long magnetic compact fixed in the groove of the main body part in which an interposition member with a "U" character shaped cross-sectional surface is fixed in the groove of the main body part and the long magnetic compact is fixed in the concave portion of the interposition member.

DETAILED DESCRIPTION OF THE PREFERRED EMBODIMENTS

A First Embodiment of a Magnetic Field Generating Member

Figure 1:
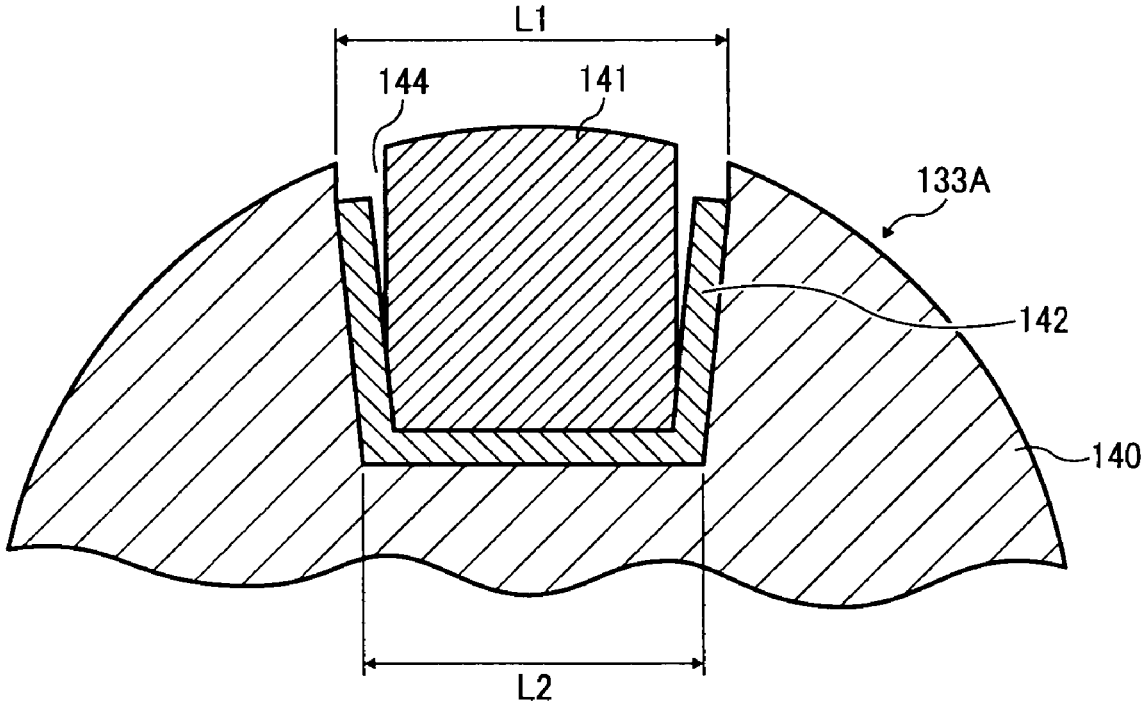
FIG. 1 is an enlarged cross-sectional diagram (along the II-II line of FIG. 18) that illustrates a first embodiment of a magnet roller according to the present invention.
Figure 2:
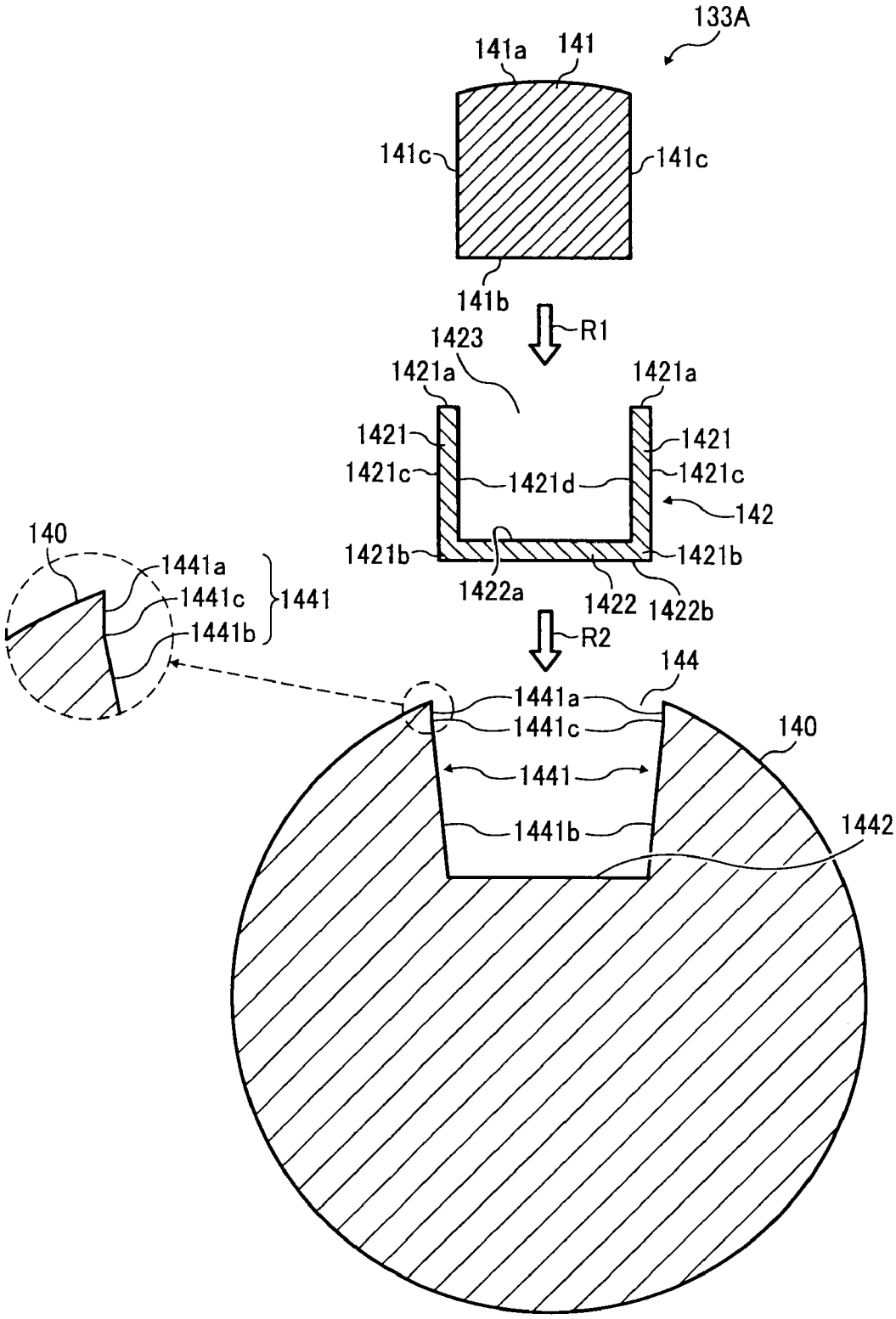
FIG. 2 is a cross-sectional diagram that illustrates an assembly method of the magnet roller of FIG. 1.
Figure 3:
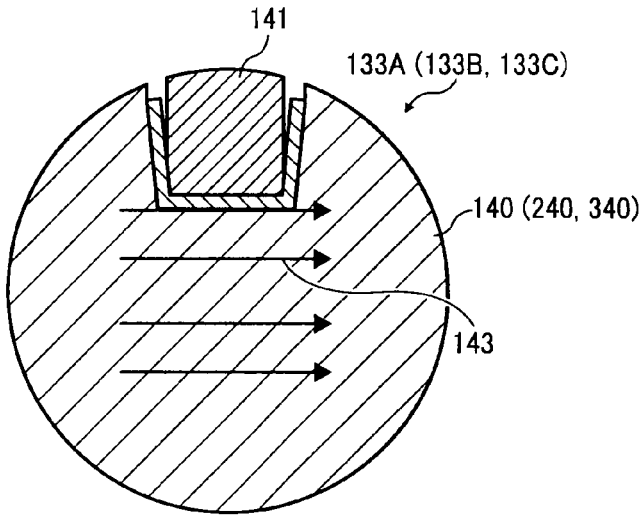
FIG. 3 is a diagram that illustrates an oriented direction of magnetic anisotropy in a main body part of the magnet roller of FIG. 1.
Figure 4:
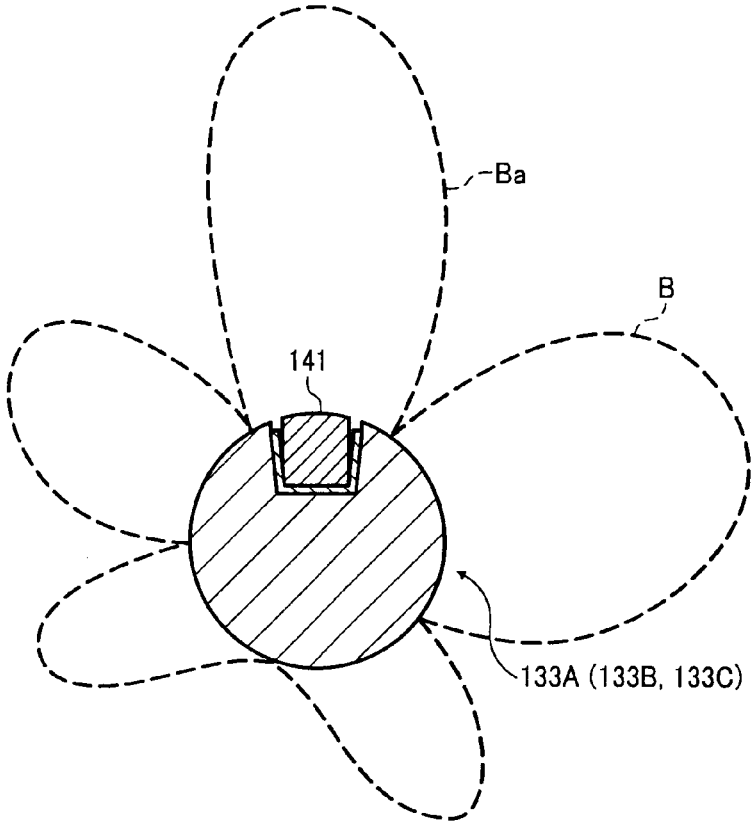
FIG. 4 is a diagram that illustrates in a frame format the strength of the magnetic force on the external surface of the magnet roller of FIG. 1.
Figure 5:
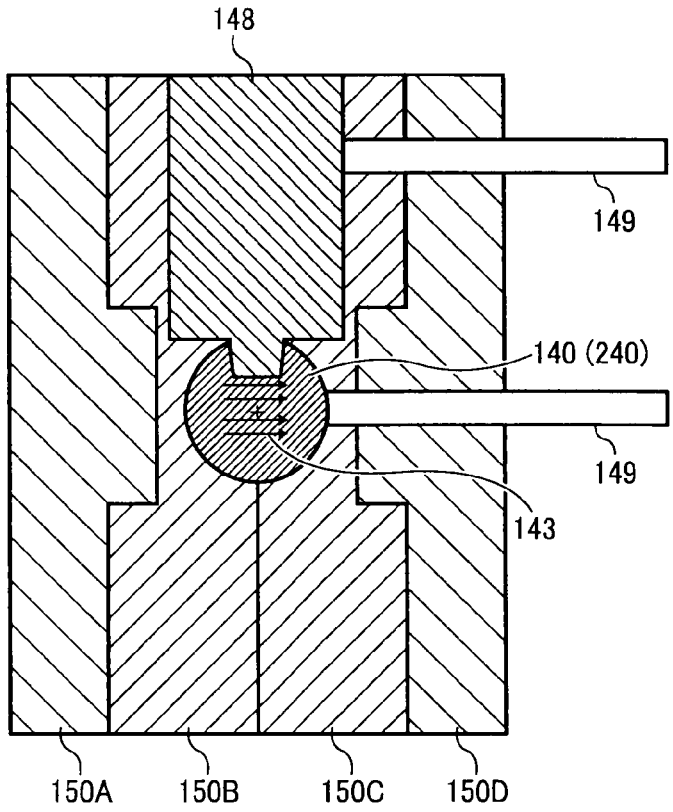
FIG. 5 is a cross-sectional diagram that illustrates an approximate structure of a metal mold that shapes the main body part of the magnet roller of FIG. 1.

FIG. 1 is an enlarged cross-sectional diagram that illustrates a first embodiment of a magnet roller according to the present invention. FIG. 2 is a cross-sectional diagram that illustrates an assembly method of the magnet roller of FIG. 1. FIG. 3 is a diagram that illustrates an oriented direction of magnetic anisotropy in a main body part of the magnet roller of FIG. 1. FIG. 4 is a diagram that illustrates in a frame format the strength of the magnetic force on the external surface of the magnet roller of FIG. 1. FIG. 5 is a cross-sectional diagram that illustrates an approximate structure of a metal mold that shapes the main body part of the magnet roller of FIG. 1.

A magnet roller 133A of the present embodiment includes a cylindrical image development sleeve 132 (illustrated in FIG. 18) shaped so that the magnet roller 133A becomes an internal capsule and an image development roller 115 as a magnetic particle support body. The magnet roller 133A is a magnetic field generating member that generates magnetic force on an external surface of the image development roller 115 to support a so called binary developer agent (described as developer agent hereinbelow) including toners and magnetic carriers 135 (illustrated in FIG. 17).

The magnet roller 133A, as illustrated in FIG. 1, includes a main body part (main body) 140, an interposition member 142 and a magnetic member, for example, a rare earth magnet block 141 as a long magnetic compact.

The main body part 140 is shaped into a cylindrical column-like body using magnetic materials. The so-called plastic magnet or rubber magnet that mixes magnetic powders with high polymer compounds can be used as the magnetic materials. Sr ferrite or Ba ferrite is used as the magnetic powders. PA (polyamide) series materials of 6 PA or 12 PA or the like, ethylene series compounds of EEA (ethylene ethyl copolymer) or EVA (ethylene vinyl copolymer) or the like, chlorine series materials of CPE (chlorinated polyethylene) or the like and rubber materials of NBR or the like can be used as the high polymer compounds. A linear main body groove 144 is disposed along the longitudinal direction on the external surface of the main body part 140. In addition, an axial part protruding from both end surfaces of the main body part 140 in the same axial direction is shaped in integration. In addition, in the main body part 140, a portion of the cylindrical column-like body can be cut along the axial direction so that a portion of the external surface is in plane shape.

The main body groove 144 is equal to the groove provided in the main body described in the claims. A cross-section (lateral cross-section) of the main body groove 144 orthogonal to the axial direction of the main body part 140 is concave and approximately rectangular shaped in the external circumference surface of the main body part 140. The main body groove 144 is extended linearly along the longitudinal direction of the main body part 140 and disposed across the whole length of the main body part 140. In addition, the main body groove 144 is disposed to oppose a later-described photosensitive drum 108 (that is, in a position of an image development magnetic pole) when the magnet roller 133A is incorporated into a later-described image development device 113 (illustrated in FIG. 19).

The main body groove 144, as illustrated in FIG. 2, includes a pair of side surfaces 1441 and a bottom surface 1442.

The pair of side surfaces 1441 respectively include a pair of straight surfaces 1441*a* and a pair of tapered surfaces 1441*b* disposed thereof.

The pair of straight surfaces 1441*a* are rectangular plane surface parts disposed mutually parallel and mutually opposed in the vicinity of an opening part of the main body groove 144 along the longitudinal direction and orthogonal to the width direction of the opening part. The width (short side direction) of the pair of straight surfaces 1441*a* has differing adequate values according to the shape of the groove. If the width of the straight surface 1441*a* is too short, sufficient effects that prevent the drop off of the interposition member 142 can not be obtained. In addition, if the width of the straight surface 1441*a* is too long, a placed piece 148 (FIG. 5) that constitutes the metal mold for shaping the main body groove 144 can not be pulled out from the main body part 140 during shaping of the main body part 140.

The pair of tapered surfaces 1441*b* are rectangular plane surface parts shaped so that mutual intervals between the pair 1441*b* gradually narrow from lower ends of the straight surfaces 1441*a* (long sides) towards a bottom surface 1442 the closer to the bottom surface 1442. The pair of tapered surfaces 1441*b* is shaped to form an angle against the pair of straight surfaces 1441*a* with a direction in which the two come mutually closer by 3 to 10 degrees (that is, an angle, tapered angle hereinbelow, against a direction orthogonal to the width direction of the opening part of the main body groove 140). The pair of tapered surfaces 1441*b* are constituted so that the above-described placed piece 148 of the metal mold can be easily pulled out.

Each of the long sides of the pair of tapered surfaces 1441*b* is respectively connected to the bottom surface 1442. The bottom surface 1442 is shaped parallel to the width direction of the opening part of the main body groove 144. The width L2 of the bottom surface 1442 is shaped to be narrower than the width L1 of the opening part of the main body groove 144. Depth from the opening part of the main body groove 144 to the bottom surface 1442 (that is, depth of the main body groove 144) is determined according to specific constitutions but if the depth is too shallow, the height (the length of the short side direction) of a pair of wall sections 1421 of the later described interposition member 142 becomes insufficient. Therefore, stiffening effects by the interposition member 142 cannot be obtained sufficiently.

The main body part 140 uses a metal mold of a structure illustrated in FIG. 5 and is manufactured by injection and magnetic field molding. The metal mold shapes the main body part 140. The main body groove 144 is shaped by disposing the placed piece 148 at the position of the metal mold. In order for the placed piece 148 to be detached (pulled out) easily from the main body part 140, a so-called pull out gradient (tapered angle) of about 3 to 10 degrees is applied. The pair of tapered surfaces 1441*b* is tapered shaped due to the pull out gradient. Desired shapes of the main body groove can be obtained according to the shape of the placed piece 148.

When injection molding of the main body part 140 is complete, a nesting 150A and a nesting 150B of the fixed side do not move. A nesting 150C and a nesting 150D of the movable side together with the placed piece 148, the EJ (ejection) pin 149 and the main body part 140 move in the right direction inside FIG. 5 (mold opening). Next, the EJ pin 149 pushes out the main body part 140 and the placed piece 148 (eject). Next, the placed piece 148 is detached from the main body part 140 so that the main body part 140 can be obtained.

An orientated direction 143 of magnetic field (magnetic anisotropy) of the main body part 140, as illustrated in FIG. 3, in the case of one direction, is approximately parallel to the bottom surface 1442 of the main body groove 144 and approximately orthogonal to the axial direction. In the case of 4 equally divided poles also, one direction should desirably be parallel to the bottom surface 1442 of the main body groove 144 and orthogonal to the axial direction, but it is not limited to such.

The interposition member 142 is obtained by shaping general plastic materials. The interposition member 142 can be also obtained by applying bending work to metal materials. Non-magnetic materials should be preferably used for either the plastic materials or the metal materials used for the interposition member 142. The rare earth magnet block 141 as the internal capsule has magnetic poles. When the interposition member 142 using non-magnetic materials is fixed in the main body groove 144, with regard to the magnetic poles, peak magnetic flux density on the external surface of the main body part 140 becomes higher so that the attachment of a magnetic carrier 135 contained in the developer agent becomes advantageous.

In order to improve stiffness property of the magnet roller 133A by the interposition member 142, usage of the metal materials is comparatively advantageous. Within non-magnetic metal materials, spring materials of SUS301 are further advantageous from the viewpoints of property and cost. Within spring materials of SUS301, ½H (more than 310 HV) or ¾H (more than 370 HV) or H (more than 430 HV) or EH (more than 490 HV) is further desirable but the higher the hardness, the easier a crack can be generated to bent sections or the like during bending work so that attention is necessary.

The interposition member 142 is shaped to the same length as the main body groove 144. A cross-section of the short side direction of the interposition member 142 (that is, lateral cross section) is "U" character shaped. The interposition member 142 includes a floor part 1422 and a pair of wall sections 1421. The rare earth magnet block 141 is fixed in a concave portion 1423 of the interposition member 142 by press-fitting. In addition, the concave portion 1423 is shaped by the floor part 1422 and the pair of wall sections 1421. The concave portion 1423 is equal to the concave portion of an interposition member described in the claims.

The floor part 1422 is a rectangular flat plate shaped so that its width (short side direction) matches with the width of the bottom surface 1442 of the main body groove 144 so that the two widths cross over. The floor part 1422 is disposed so that when the interposition member 142 is fixed in the main body groove 144 by press-fitting, its lower surface 1422*b* comes into contact with the bottom surface 1442.

The pair of wall sections 1421 is rectangular flat plates disposed uprightly and forming two approximate right angles. The angles are formed from a pair of mutually opposing long sides of the floor part 1422 against the floor part 1422. The length (that is, height) from an upper end 1421*a* to a lower end 1421*b* of the pair of wall sections 1421 is preferably shaped to equal the width of the tapered surface 1441*b* of the main body groove 144. When the interposition member 142 is press-fitted into the main body groove 144, an external surface 1421*c* of the pair of wall sections 1421 comes into contact with the tapered surface 1441*b* and the upper end 1421*a* is positioned in a boundary 1441*c* between the straight surface 1441*a* and the tapered surface 1441*b*. Thereby the upper end 1421*a* is caught in the boundary 1441*c* (that is, the straight surface 1441*a*) so that drop off of the interposition member 142 from the main body groove 144 can be prevented.

The thickness of the floor part 1422 and the pair of wall sections 1421 of the interposition member 142 has differing adequate values according to the shape of the main body part. The floor part 1422 and the pair of wall sections 1421 should be advantageously thickened in order to improve stiffness property. But desired magnetic forces (for example, the Ba illustrated in FIG. 4) by the rare earth magnetic block 141 become difficult to obtain if the floor part 1422 and the pair of wall sections 1421 become too thick.

The rare earth magnetic block 141 is equal to a long magnetic compact described in the claims and has the same length as the interposition member 142. A cross-section (lateral cross-section) of the short side direction of the rare earth magnet block 141 is rectangular shaped fitting into the shape of the cross-section of the concave portion 1423 of the interposition member 142. The rare earth magnetic block 141 as a whole is in the shape of a long rod and is fixed in the concave portion 1423 of the interposition member 142 by press-fitting. Then the rare earth magnetic block 141, together with the interposition member 142, is fixed in the main body groove 144 by press-fitting. Thereafter the main body part 140 (that is, the image development roller 115) is disposed so that the rare earth magnet block 141 and the photosensitive drum 108 mutually oppose. The rare earth magnet block 141 forms an image development magnetic pole and generates magnetic forces on the external surface of the image development sleeve 132, that is, the image development roller 115 so that a magnetic field is formed between the image development sleeve 132 and the photosensitive drum 108. The rare earth magnet block 141 forms magnetic brushes by the magnetic field so that toners of the developer agent adsorbed to the external surface of the image development sleeve 132 are transferred to the photosensitive drum 108. In such a way, the rare earth magnet block 141 forms on the external surface of the image development sleeve 132 an image development area 131 (FIG. 19) that transfers the toners of the developer agent attached to the above-described external surface of the image development sleeve 132 to the photosensitive drum 108.

Magnetic particles are constituted from a rare earth magnetic body. A magnet compound including magnetic powders constituted from the magnetic particles is filled into the pressed metal mold inside a magnetic field and compression molded to obtain the rare earth magnet block 141. In compression molding, only a small quantity of binding resin is necessary for possible molding so that the compounding ratio of magnetic powders can be heightened. In addition, the molding density of the rare earth magnet block 141 can be heightened by the compression molding so that the compression molding is an excellent method for obtaining higher magnetic force. However, because the quantity of the binding resin is small, there is a tendency for a lack of strength.

The magnet compound used for compression molding is constituted from minute resin particles having thermal plasticity as well as rounded off magnetic powders of an average particle diameter of 80 to 150 μm and a powder density of 3.3 g/cm$^3$ to 4.0 g/cm$^3$. The compression molded magnet compound is heated thereafter so that binding forces with the magnetic powders increases because the minute resin particles having thermal plasticity are melted-through.

The compounding ratio of the magnetic powders in the magnet compound is preferably 90 to 99 wt % and further preferably, 92 to 97 wt %. If contained amount of the magnetic powders is too small, improvement of magnetic property cannot be realized. In addition, if the contained amount of the magnetic powders is too great, the contained amount of the binding resin becomes small so that moldability of the magnet block deteriorates (generation of cracks or the like).

The rare earth magnet block 141 can also be obtained by injection molding the magnet compound inside a magnetic field. The quantity of binding resins needed for the injection molding is more than that of the compression molding so that the compounding ratio of magnetic powders becomes difficult to be heightened. In addition, the magnetic force of the magnetic powders including a rare earth element is reduced by heat because the binding resins are melted-through at a high temperature. Therefore, injection molding is inferior to compression molding from a viewpoint of obtaining a high magnetic force. However, since the quantity of the binding resins is large and the binding resins are solidified after melt-through, the binding force is strong. Therefore, injection molding is an excellent method for increasing strength.

The injection molded magnet compound is constituted from thermal plastic resins as well as rounded off magnetic powders of an average particle diameter of 80 to 150 μm and a powder density of 3.3 g/cm$^3$ to 4.0 g/cm$^3$. In the injection molding, magnetic powders including rare earth element are shaped in a dispersed state within melted-through thermal plastic resins and cooled for solidifying. Therefore, a rare earth magnet block of a higher strength than that by compression molding can be obtained.

The compounding ratio of the magnetic powders in the magnet compound is preferably 80 to 95 wt % and further preferably, 87 to 93 wt %. If the amount of the magnetic powders contained is too small, no improvement in the magnetic property can be realized. In addition, if the amount of the magnetic powders contained is too great, the fluidity decreases and injection molding becomes difficult.

The magnetic powders are constituted from magnetic particles. The magnetic particles are constituted from rare earth magnetic bodies capable of realizing a high magnetic force (more than 13 MGOe). The rare earth magnetic bodies are preferably the following (i) to (iii) constituted from alloy including rare earth elements and transition metals, but most preferably, the following (i).

(i) An alloy with B and transition metals of mainly R (however, R is at least one kind of rare earth element including Y) and Fe as the basic components (the so-called R—Fe—B series alloy). Representative alloys of this kind are Nd—Fe—B series alloy, Pr—Fe—B series alloy, Nd—Pr—Fe—B series alloy, Ce—Nd—Fe—B series alloy, Ce—Pr—Nd—Fe—B series alloy, as well as other alloys substituting a portion of the Fe within these alloys to other transition metals of Co and Ni or the like.

(ii) An alloy with rare earth elements of mainly Sm and transition metals of mainly Co as the basic components (the so-called Sm—Co series alloy). SmCo5 and Sm2TM17 (TM is a transition metal) can be cited as representative alloys of this kind.

(iii) An alloy with rare earth elements of mainly Sm, transition metals of mainly Fe and interstitial elements of mainly N as the basic components (the so-called Sm—Fe—N series alloy). Sm2Fe17N3 prepared by azotizing Sm2TM17 alloy can be cited as a representative alloy of this kind.

Y, La, Ce, Pr, Nd, Pm, Sm, Eu, Gd, Tb, Dy, Ho, Er, Tm, Yb, Lu and misch metal or the like can be included as the rare earth elements. One kind or two kinds or more of these rare earth elements can be included in the alloy. In addition, Fe, Co and Ni or the like can be included as the transition metals. One kind or two kinds or more of these transition metals can be included in the alloy. In addition, in order to improve the magnetic property, B, Al, Mo, Cu, Ga, Si, Ti, Ta, Zr, Hf, Ag and Zn or the like can be included in the alloy as magnetic powders according to necessity.

The average particle diameter of a volume of magnetic particles that constitutes the magnetic powders is preferably 80 to 150 μm and further preferably, 90 to 140 μm. The average particle diameter is measured by a DRY unit of a Mastersizer 2000 made by Sysmex Corp.

The average particle diameter of the minute resin particles having thermal plasticity is preferably not over one tenth (1/10) of the average particle diameter of the magnetic particles of the magnetic powder. As stated above, the average particle diameter in such a way is not over one tenth (1/10) of the magnetic particles of the magnetic powders. Therefore, the molding density of the magnet compact can possibly be heightened and the magnetic property can be improved.

The minute resin particles having thermal plasticity are preferably minute particles of a spherical shape manufactured by an emulsion polymerization method or a suspension polymerization method. As stated above, the minute resin particles of thermal plasticity in such a way are spherical shaped minute particles manufactured by the emulsion polymerization method or the suspension polymerization method. Therefore, a compression molded product of high density can possibly be obtained. Thereby the magnetic property can be further improved. In addition, when spherical minute particles as such are used, areas covering the magnetic powders are improvingly increased so that areas in which the magnetic powders are exposed on the surface of the magnet compact can be decreased and effects that prevent corrosion are generated.

For example, styrene series compounds of polystyrene, polychloroethylene and polyvinyltoluene or the like and mono-polymers constituted from their substitution products as well as styrene series copolymers of styrene-p-chlorostyrene, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chlormethacrylate copolymer, styrene-acrylic nitrile copolymer, styrene-vinyl methyl ether copolymer, styrene-vinyl methyl ketone copolymer, styrene-butadiene copolymer, styrene-isoprene copolymer, styrene-acrylic nitrile-indene copolymer, styrene-maleic acid copolymer and styrene-maleic acid ester copolymer or the like can be cited as the thermal plastic resin that constitutes the minute resin particles of thermal plasticity. In addition, the thermal plastic resin can be resins of polymethylmethacrylate, polybutylmethacrylate, polyvinyl chloride, polyvinyl acetate, polyethylene, polypropylene, polyester, polyvinyl butyl butyral, polyacrylate resin, rosin, denatured rosin, terpene resin, phenol resin and epoxy-polyol series resin or the like. One kind of these resins can be used. In addition, two kinds or more of these resins can be mixed for usage.

The minute resin particles having thermal plasticity, as described above, are used as the binding resin (binder). For example, a charged control agent (CCA), a colorant and a material of low softening point (wax) are dispersed in and mixed with the thermal plastic resins of polyester, polyol or the like. Materials of silica, oxidized titanium or the like are added externally as an external addition agent to the periphery thereof so that fluidity is heightened. The added quantity of the colorant is 1 to 20 wt % and preferably, 5 to 10 wt %. The charged control agent is added to improve dispersing quality of magnet particles and the minute resin particles having thermal plasticity. The added quantity of the charged control agent is 1 to 20 wt % and preferably, 0.5 to 10 wt %. A mold release agent is added to improve mold release properties after molding. The added quantity of the mold release agent is 1 to 20 wt % and preferably, 2 to 10 wt %. The minute resin particles 153 having thermal plasticity are excellent in fluidity and easily charged to negative. Therefore, the minute resin particles 153 having thermal plasticity have superior electrostatic attachment force with the magnetic powders so that gaps between the magnet particles can be filled sufficiently.

For example, oxidized aluminum, oxidized titanium, strontium titanate, oxidized cerium, magnesium oxide, chrome oxide, tin oxide, metal oxide of zinc oxide or the like, nitride of silicon nitride or the like, carbide of silicon carbide or the like, calcium sulfate, barium sulfate, metallic salt of calcium carbonate or the like, fatty acid metal salt of zinc stearate, calcium stearate or the like, carbon black and silica can be cited as the external addition agent for the minute resin particles having thermal plasticity. Particle diameter of the external addition agent is normally in a range of 0.1 to 1.5 μm. If the quantity before addition of the external addition agent is 100 parts by weight, the added quantity of the external addition agent is preferably 0.01 to 10 parts by weight and further preferably 0.05 to 5 parts by weight. These external addition agents can be used singly or in combination of two or more. In addition, these external addition agents are preferably applied hydrophobized processing.

For example carbon black, lampblack, magnetite, titan black, chrome yellow, ultramarine blue, aniline blue, phthalocyanine blue, phthalocyanine green, hansa yellow G, rhodamine 6G, chalco oil blue, quinacridone, benzidine yellow, rose bengal, malachite green lake, quinoline yellow, C.I. Pigment Red 48:1, C.I. Pigment Red 122, C.I. Pigment Red 57:1, C.I. Pigment Red 184, C.I. Pigment Yellow 12, C.I. Pigment Yellow 17, C.I. Pigment Yellow 97, C.I. Pigment Yellow 180, C.I. Solvent Yellow 162, C.I. Pigment Blue 5:1, C.I. Pigment Blue 15:3 and carmine or the like can be cited as the colorant.

In addition, the material having low softening point can be added internally to the internal parts of the minute resin particles having thermal plasticity. Paraffin wax, polyolefin wax, Fischer-Tropsch wax, amide wax, higher fatty acid, ester wax and derivative of these or graft/block compound of these can be cited as the materials of low softening point as such. In the case the material having low softening point as such is added, about 5 to 30 mass % should preferably be added.

The rare earth magnet block 141 has a maximum magnetic flux density of 100 to 130 mT and therefore, higher magnetic force (13 to 16 MGOe) than a conventional plastic magnet having a maximum magnetic flux density of 80 to 120 mT. The rare earth magnet block 141 can be press-fitted into the concave portion 1423 of the interposition member after magnetization or alternatively, magnetized after being press-fitted into the concave portion 1423 of the interposition member. In addition, in the present embodiment, the magnet block used includes rare earth elements but the materials used for the magnet block are not limited to such and can be randomly selected if the necessary magnetic force can be obtained.

A plurality of fixed magnetic poles that generates magnetic force (illustrated in a frame format in FIG. 4 and includes the rare earth magnet block 141 as the image development magnetic pole with other components not illustrated) are disposed in the magnet roller 133A. Line B illustrated in FIG. 4 shows in a frame format the size of the magnetic forces (magnetic flux density) generated by each magnetic pole. The magnetic forces head towards normal directions in the external circumference surface of the magnet roller 133A. FIG. 4 illustrates that the farther the line B is away from the external surface of the magnet roller 133A, the larger the magnetic force. In particular, line Ba illustrates the size of the magnetic force (magnetic flux density) generated by the rare earth magnet block 141.

Fixed magnetic poles disposed in the magnet roller 133A except the image development magnetic pole are formed with a portion of the main body part 140 corrected to north pole (N) or south pole (S). Fixed magnetic poles are extended along the longitudinal direction of the magnet roller 133A and disposed across the whole length of the magnet roller 133A.

The image development device 113 includes a stirring screw 118. One of the fixed magnetic poles is disposed opposed to the stirring screw 118. The one fixed magnetic pole forms a pumping magnetic pole and generates magnetic force on the external surface of the image development sleeve 132, that is, the image development roller 115 so that the developer agent is adsorbed to the external surface of the image development sleeve 132.

At least one fixed magnetic pole is disposed between the above described pumping magnetic pole and the main body groove 144. The at least one fixed magnetic pole generates magnetic force on the external surface of the image development sleeve 132, that is, the image development roller 115 and delivers the before image development developer agent towards the photosensitive drum 108.

These fixed magnetic poles generate magnetic forces on the external surface of the image development sleeve 132. Then magnetic carriers 135 contained in the developer agent mutually overlap along magnetic lines generated by the fixed magnetic poles and are arranged in an erect manner (spike erect) on the external surface of the image development sleeve 132. As just described, the state in which a plurality of magnetic carriers 135 overlap along the magnetic lines and are arranged in an erect manner on the external surface of the image development sleeve 132 is termed the magnetic carriers 135 spike erects on the external surface of the image development sleeve 132. Then, the above-described toners are adsorbed to the spike erected magnetic carriers 135. That is, the image development sleeve 132 adsorbs the developer agent to its external surface by the magnetic force of the magnet roller 133A.

In addition, an agent severance pole (not illustrated) that weakens the magnetic force generated on the external surface of the image development roller 115 so that the developer agent drops off from the external surface of the image development roller 115 is disposed in the magnet roller 133A at an approximately opposed position against the above-described image development magnetic pole. The agent severance pole is extended along the longitudinal direction of the magnet roller 133A and disposed across the whole length of the magnet roller 133A.

Next, an assembly method of the magnet roller 133A is described. First, the rare earth magnet block 141 is press-fitted into the concave portion 1423 of the interposition member 142 in a direction of an arrow R1 of FIG. 2 to be fixed thereof. At this moment, a bottom surface 141*b* and side surfaces 141*c* of the rare earth magnet block 141 are press-fitted to respectively come into contact with an upper surface 1422*a* and inner surfaces 1421*d* of the interposition member 142.

Next, the interposition member 142 press-fitted with the rare earth magnet block 141 is press-fitted into the main body groove 144 in a direction of an arrow R2 of FIG. 2 to be fixed thereof. At this moment, the press-fitting is performed so that the lower surface 1422*b* of the interposition member 142 comes into contact with the bottom surface 1442 of the main body groove 144 and the external surface 1421*c* of the interposition member 142 comes into contact with the tapered surface 1441*b* of the main body groove 144 and furthermore, the upper end 1421*a* of the pair of wall sections 1421 of the interposition member 142 is positioned in a boundary 1441*c* of the main body groove 144.

Finally, fixed magnetic poles necessary for the image development roller 115 are magnetized by an electromagnet type magnetizing yoke. Thereby the magnet roller 133A is completed. In addition, in the present embodiment, each member is press-fitted to be fixed but it is not limited to such. For example, each member can be mutually fixed using an adhesive agent.

In the above-described assembly method (manufacturing method) of the magnet roller 133A, the interposition member 142 is press-fitted into the main body groove 144 after the rare earth magnet block 141 is press-fitted into the concave portion 1423 of the interposition member 142 so that the rare earth magnet block 141 is reinforced by the interposition member 142. Therefore, bending and damages generated when the rare earth magnet block 141 is press-fitted into the main body groove 144 can be prevented. Consequently, the assembly workability of the magnet roller 133A and the yield ratio of the rare earth magnet block 141 can be improved so that productivity can be heightened.

In addition, in FIG. 1, there seemingly is a gap between the rare earth magnet block 141 and the interposition member 142 but actually, only an extremely minute gap exists between the two members.

In addition, in the present embodiment, the main body part 140 is shaped to have an external diameter of 8.5 mm and an overall length of 313 mm. The main body groove 144 is shaped to have a length of 313 mm. In the main body groove, the bottom surface 1442 is shaped to have a width of 2.7 mm, the pair of straight surfaces 1441*a* in the pair of side surfaces 1441 is shaped to have a width of 0.17 mm and the pair of tapered surfaces 1441*b* in the pair of side surfaces 1441 is shaped to have a width of 2.2 mm. The tapered surfaces are shaped to have a 5 degree angle against the straight surfaces. In addition, the interposition member 142 is shaped to have a length of 313 mm and a thickness of 0.3 mm. In the interposition member 142, the width of the floor part 1422 is shaped to 2.6 mm and the height of the pair of wall sections 1421 is shaped to 2.3 mm. The pair of wall sections 1421 is shaped to have a 95 degree angle against the floor part 1422. The rare earth magnet block 141 is shaped to have a width of 2.0 mm, a height of 2.4 mm and a length of 313 mm. Each of these dimensions is only an example and can be adequately determined according to constitutions or the like.

As described above, according to the present invention, the interposition member 142 with a "U" character shaped cross-sectional surface is fixed in the main body groove 144 of the cylindrical column-like shaped main body part 140. The rare earth magnet block 141 is fixed to the concave portion 1423 of the interposition member 142 so that the main body part 140 is reinforced by the interposition member 142 and stiffness property of the main body part 140 can be heightened. Therefore, even in the case the main body part 140 is shifted to a smaller diameter (that is, smaller size), the stiffness property of the main body part 140 can be secured. Consequently, the magnet roller 133A can be provided with heightened stiffness property and smaller size.

In addition, the interposition member 142 is fixed in the main body groove 144 by press-fitting so that it is not necessary to use an adhesive agent for the fixture of the two members. Therefore, the interposition member 142 can be detached easily from the main body groove 144. Consequently, reuse of the interposition member 142 becomes possible and the magnet roller 133A can be provided at a cheap price. In addition, because an adhesive agent is not used for the fixture of the interposition member 142 and the main body groove 144, positional displacements of these members generated by the thickness of the adhesive agent or due to the drying of the adhesive agent can be avoided. Therefore, high precision assembly is possible.

In addition, the rare earth magnet block 141 is fixed in the concave portion 1423 of the interposition member 142 by press-fitting so that it is not necessary to use an adhesive agent for the fixture of the two members. Therefore, the rare earth magnet block 141 can be detached easily from the interposition member 142. Consequently, reuse of the expensive rare earth magnet block 141 becomes possible and the magnet roller 133A can be provided at a cheap price. In addition, because an adhesive agent is not used for the fixture of the interposition member 142 and the rare earth magnet block 141, positional displacements of these members generated by the thickness of the adhesive agent or due to the drying of the adhesive agent can be avoided. Therefore, high precision assembly is possible.

In addition, the pair of side surfaces 1441 of the main body groove 144 includes the pair of straight surfaces 1441*a* shaped mutually parallel in the vicinity of the opening part of the main body groove 144 and the pair of tapered surfaces 1441*b* shaped so that mutual intervals between the pair 1441*b* gradually narrow from lower ends of the straight surfaces 1441*a* towards the bottom surface 1442 the closer to the bottom surface 1442. Therefore, when the interposition member 142 is press-fitted into the main body groove 144, the pair of straight surfaces 1441*a* serves as stoppers and drop off of the interposition member 142 from the main body groove 144 can be prevented. The image development device or the like breaks down due to the drop off of the interposition member 142. Consequently, the magnet roller 133A with high reliability that can prevent such breakdowns is provided.

In addition, an external surface 1421*c* of the pair of wall sections 1421 in the interposition member 142 respectively comes into close contact with the pair of tapered surfaces 1441*b* in the main body groove 144. The upper end 1421*a* of the pair of wall sections 1421 is respectively shaped to be positioned in the boundary 1441*c* between the straight surface 1441*a* and the tapered surface 1441*b*. Therefore, when the interposition member 142 is press-fitted into the main body groove 144, the upper end 1421*a* of the pair of wall sections 1421 is caught in the boundary 1441*c* so that the two members are mutually fixed more reliably. Consequently, drop off of the interposition member 142 from the main body groove 144 can be prevented more reliably. The image development device or the like breaks down due to the drop off of the interposition member 142. Hence the magnet roller 133A with high reliability that can prevent such breakdowns is provided.

In addition, the interposition member 142 is shaped using non-magnetic materials. In comparison to a case in which magnetic materials are used for the interposition member 142, peak magnetic flux density on the external surface of the image development roller 115 (a part of the external surface of the image development roller 115 corresponds to the position of the interposition member 142) can be heightened (that is, the highest point of the line Ba illustrated in FIG. 4 can be set farther apart from the external surface of the magnet roller 133A). Therefore, the developer agent can be more reliably supported on the external surface of the image development roller 115 and attachment of the developer agent to the photosensitive drum 108 or the like can be prevented.

In addition, non-magnetic metals are used for the interposition member 142 so that stiffness property of the magnet roller 133A can be further heightened.

In addition, by applying magnetic force (magnetic field) in a direction approximately parallel to the bottom surface 1442 of the groove 144 of the main body part and approximately orthogonal to the axial direction of the main body part, magnetic anisotropy is provided. Therefore, a point that shifts magnetic poles of the magnetic force (pole shift point) can be generated in the vicinity of the opening part of the groove so that magnetic force at this position can be lessened. Hence the developer agent attached to the magnetic particle support body can be cut at this position so that the developer agent drops off from the external surface of the image development roller 115. Consequently, rotations under a state in which the developer agent is ceaselessly adhering to the external surface of the image development roller 115 due to the magnetic particle support body can be prevented.

In addition, the magnet roller 133A includes the rare earth magnet block 141 that contains rare earth elements so that high magnetic force can be realized.

A Second Embodiment of the Magnetic Field Generating Member

Figure 6:
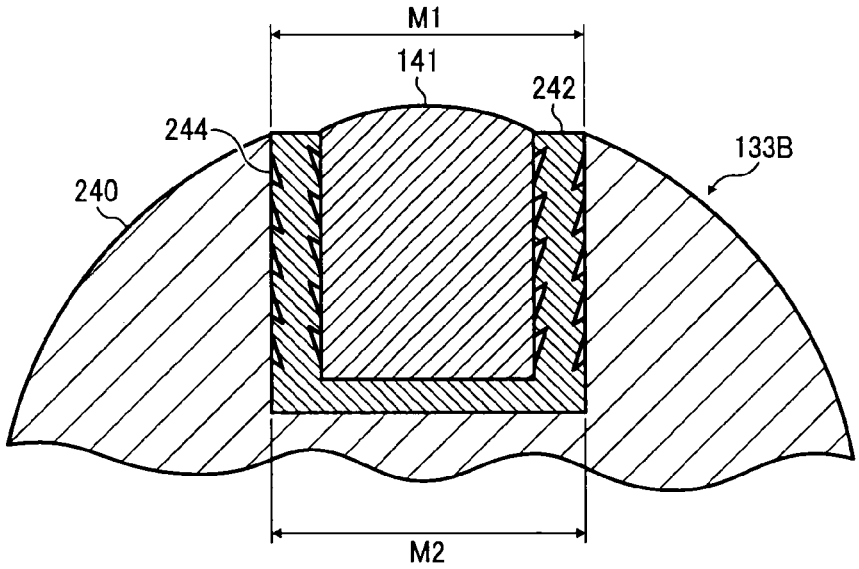
FIG. 6 is an enlarged cross-sectional diagram that illustrates a second embodiment of the magnet roller according to the present invention.
Figure 7:
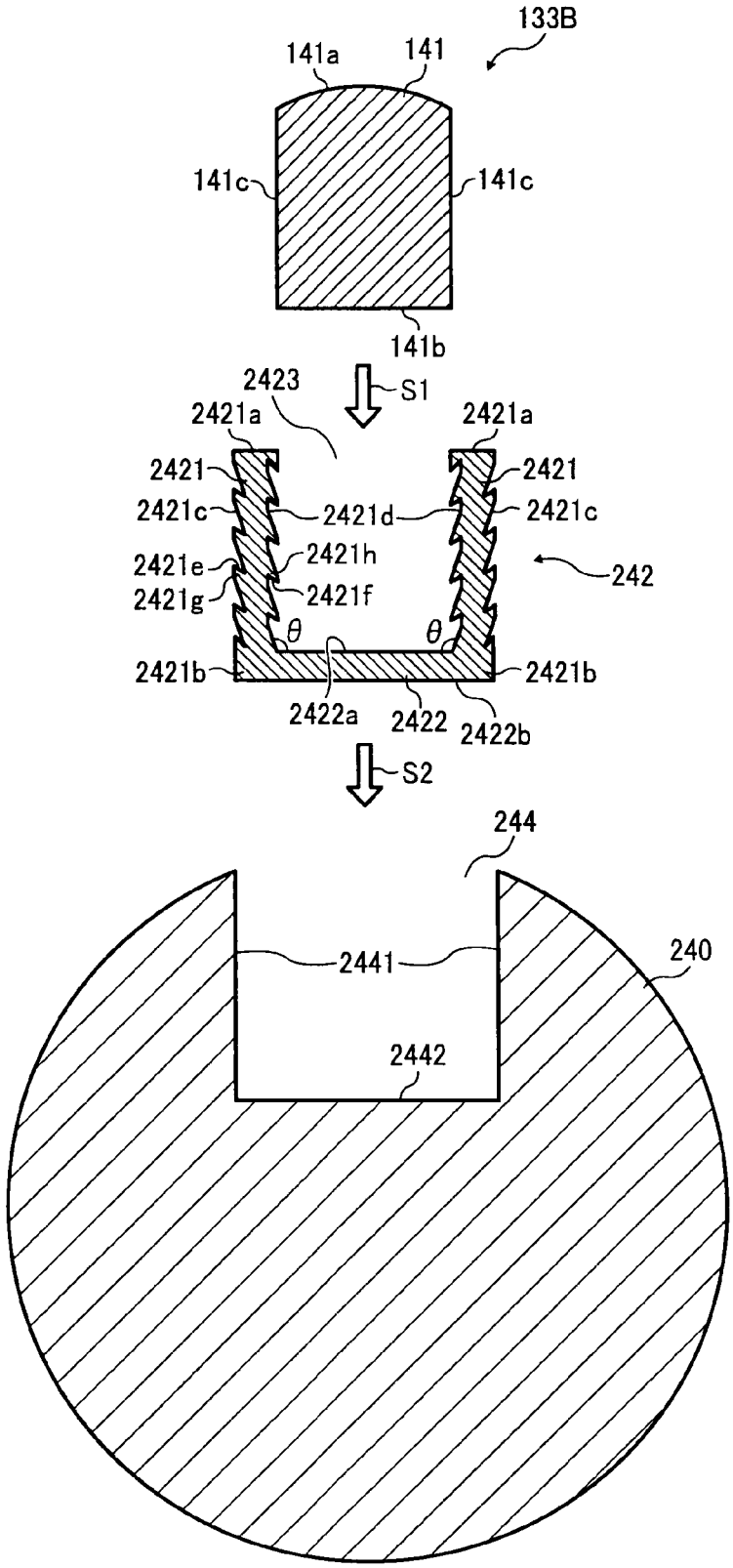
FIG. 7 is a cross-sectional diagram that illustrates an assembly method of the magnet roller of FIG. 6.

FIG. 6 is an enlarged cross-sectional diagram that illustrates a second embodiment of the magnet roller according to the present invention. FIG. 7 is a cross-sectional diagram that illustrates an assembly method of the magnet roller of FIG. 6. In FIG. 6 and FIG. 7, the same reference numbers are assigned to parts with the same constitutions to the first embodiment and descriptions of which are abbreviated hereby.

A magnet roller 133B of the present embodiment, as illustrated in FIG. 6, includes a main body part (main body) 240, an interposition member 242 and a magnetic member, for example, the rare earth magnet block 141 as the long magnetic compact.

The main body part 240 uses magnetic materials and is cylindrical column-like shaped. The same magnetic materials as the first embodiment, that is, plastic magnet or rubber magnet can be used. A linear groove 244 provided in the main body 240 is disposed along a longitudinal direction on the external surface of the main body part 240. In addition, an axial part protruding from both end surfaces of the main body part 240 in the direction of the same axial is shaped in integration. In addition, in the main body part 240, a portion of the cylindrical column-like body can be cut along the axial direction so that a portion of the external surface is in plane shape.

The main body groove 244 is equal to the groove of the main body part described in the claims. A cross-section (lateral cross-section) of the main body groove 244 orthogonal to the axial direction of the main body part 240 is concave and approximately rectangular shaped in the external circumference surface of the main body part 240. The main body groove 244 is extended linearly along the longitudinal direction of the main body part 240 and disposed across the whole length of the main body part 240. In addition, the main body groove 244 is disposed to oppose a later-described photosensitive drum 108 (that is, in a position of an image development magnetic pole) when the magnet roller 133B is incorporated into a later-described image development device 113 (illustrated in FIG. 19).

The main body groove 244, as illustrated in FIG. 7, includes a pair of side surfaces 2441 and a bottom surface 2442.

The pair of side surfaces 2441 is two opposing plane parts shaped along the longitudinal direction of the main body groove 244 and to be approximately orthogonal against a width direction of an opening part. Each long side of the pair of side surfaces 2441 is respectively connected with the bottom surface 2442. The bottom surface 2442 is a plane part shaped along the longitudinal direction of the main body groove 244 and to be approximately parallel against the width direction of the opening part. An angle formed by the pair of side surfaces 2441 and the bottom surface 2442 is preferably above 90 degrees and below 100 degrees. That is, the pair of side surfaces 2441 is tapered shaped so that a width M2 of the bottom surface 2442 is slightly smaller than the width M1 of the opening part of the main body groove 244. The pair of side surfaces 2441 is shaped as such so that the placed piece 148 (FIG. 5) that shapes the main body groove 244 can be detached (pulled out) easily. Depth from the opening part of the main body groove 244 to the bottom surface 2442 (that is, depth of the main body groove 244) is determined according to specific constitutions but if the depth is too shallow, the height (the length of the short side direction) of a pair of wall sections 2421 of the later described interposition member 242 becomes insufficient. Therefore, stiffening effects by the interposition member 242 cannot be obtained sufficiently.

The same as the main body part 140 of the first embodiment, the main body part 240 uses a metal mold of a structure illustrated in FIG. 5 and is manufactured by injection and magnetic field molding. The metal mold shapes the main body part 240. The main body groove 244 is shaped by disposing the placed piece 148 at the position of the metal mold. In order for the placed piece 148 to be detached (pulled out) easily from the main body part 240, a so-called pull out gradient (tapered angle) is applied. The pair of side surfaces 2441 is tapered shaped due to the pull out gradient. Desired shapes of the main body groove can be obtained according to the shape of the placed piece 148.

When injection molding of the main body part 240 is complete, a nesting 150A and a nesting 150B of the fixed side do not move. A nesting 150C and a nesting 150D of the movable side together with the placed piece 148, the EJ (ejection) pin 149 and the main body part 240 move in the right direction inside FIG. 5 (mold opening). Next, the EJ pin 149 pushes out the main body part 240 and the placed piece 148 (eject). Next, the placed piece 148 is detached from the main body part 240 so that the main body part 240 can be obtained.

An orientated direction 143 of magnetic field (magnetic anisotropy) of the main body part 240, as illustrated in FIG. 3, in the case of one direction, is approximately parallel to the bottom surface 2442 of the main body groove 244 and approximately orthogonal to the axial direction. In the case of 4 equally divided poles also, one direction should desirably be parallel to the bottom surface 2442 of the main body groove 244 and orthogonal to the axial direction but it is not limited to such.

The interposition member 242 is obtained, for example, by applying bending work to flat plate shaped non magnetic metal materials of a same length as the main body groove 244 so that a cross-section (lateral cross-section) of a short side direction of the non magnetic metal materials becomes "U" character shaped. The rare earth magnet block 141 as the internal capsule has magnetic poles. By using non magnetic materials for the interposition member 242, when the interposition member 242 is fixed in the main body groove 244, with regard to the magnetic poles, peak magnetic flux density on the external surface of the main body part 240 becomes higher so that the attachment of magnetic carrier 135 contained in the developer agent becomes advantageous.

The interposition member 242 can be shaped using resin materials. But in order to improve the stiffness property of the magnet roller 133B by the interposition member 142, usage of the metal materials is comparatively advantageous. Within non-magnetic metal materials, spring materials of SUS301 are further advantageous from the viewpoints of property and cost. Within spring materials of SUS301, ½H (more than 310 HV) or ¾H (more than 370 HV) or H (more than 430 HV) or EH (more than 490 HV) is further desirable but the higher the hardness, the easier a crack can be generated to bent sections or the like during bending work so that attention is necessary.

The interposition member 242 includes a floor part 2422 and a pair of wall sections 2421. The rare earth magnet block 141 is fixed in a concave portion 2423 of the interposition member 242 by press-fitting. The concave portion 2423 of the interposition member 242 is shaped by the floor part 2422 and the pair of wall sections 2421. The concave portion 2423 is equal to a concave portion of an interposition member described in the claims.

The floor part 2422 is rectangular flat plate shaped so that its width (short side direction) matches with the width of the bottom surface 2442 of the main body groove 244 so that the two widths cross over. The floor part 2422 is disposed so that when the interposition member 242 is fixed in the main body groove 244 by press-fitting, its lower surface 2422*b* comes into contact with the bottom surface 2442.

The pair of wall sections 2421 is rectangular flat plates disposed uprightly and forming angles (θ of FIG. 7) larger than 90 degrees. The angles are formed from a pair of mutually opposing long sides of the floor part 2422 against the floor part 2422. The length (that is, height of the pair of wall sections 2421) from an upper end 2421*a* to a lower end 2421*b* of the pair of wall sections 2421 is shaped to be less or equal to the width (height) of the pair of side surfaces 2441 of the main body groove 244 and preferably, to equal the width (height) of the pair of side surfaces 2441 of the main body groove 244.

In an external surfaces 2421*c* of the pair of wall sections 2421, a plurality of wedge grooves 2421*e* of the external surface directed from the upper end 2421*a* towards the lower end 2421*b* of the pair of wall sections 2421 (downward direction in FIG. 7) are disposed across the whole length of the pair of wall sections 2421 along the longitudinal direction. In addition, external surface wedges 2421*g* are shaped by disposing the plurality of wedge grooves 2421*e* of the external surface.

In an internal surfaces 2421*d* of the pair of wall sections 2421, a plurality of wedge grooves 2421*f* of the internal surface directed from the lower end 2421*b* towards the upper end 2421*a* of the pair of wall sections 2421 (upward direction in FIG. 7) are disposed across the whole length of the pair of wall sections 2421 along the longitudinal direction. In addition, internal surface wedges 2421*h* are shaped by disposing the plurality of wedge grooves 2421*f* of the internal surface.

The external surface 2421*c* of the pair of wall sections 2421 is shaped to come into contact with the pair of side surfaces 2441 of the main body groove 244 when the interposition member 242 is press-fitted into the main body groove 244. Because the wedge grooves 2421*e* of the external surface are disposed in the external surface 2421*c*, when the interposition member is press-fitted into the main body groove 244, areas in contact between the pair of side surfaces 2441 and the external surface 2421*c* decrease so that large force is not necessary for the press-fitting and assembly property is improved. In addition, after the press-fitting, the external surface wedges 2421*g* are caught by the pair of side surfaces 2441 of the main body groove 244. Therefore, drop off of the interposition member 242 from the main body groove 244 can be prevented more reliably.

In addition, the internal surface 2421*d* of the pair of wall sections 2421 is shaped to come into contact with the side surfaces 141*c* of the rare earth magnet block 141 when the rare earth magnet block 141 is press-fitted into the concave portion 2423 of the interposition member 242. Because the wedge grooves 2421*f* of the internal surface are disposed in the internal surface 2421*d*, when the rare earth magnet block 141 is press-fitted into the concave portion 2423 of the interposition member 242, areas in contact between side surfaces

141*c* of the rare earth magnet block 141 and the internal surface 2421*d* decrease so that large force is not necessary for the press-fitting and assembly property is improved. In addition, after the press-fitting, the internal surface wedges 2421*h* are caught by side surfaces 141*c*. Therefore, drop off of the rare earth magnet block 141 from the interposition member 242 can be prevented more reliably.

In addition, the wedge grooves 2421*f* of the internal surface are preferably shaped before bending work is applied to the interposition member 242. Because the shaping of the wedge grooves 2421*f* of the internal surface towards the vicinity of the floor part 2422 becomes difficult if performed after the bending work.

In addition, the length or the interval of the external surface wedge 2421*g* and the internal surface wedge 2421*h* differ according to the thickness of the interposition member 242 and the height of the pair of wall sections 2421 (that is, deepness of the concave portion 2423 of the interposition member 242). The deepness of the external surface wedge 2421*g* and the internal surface wedge 2421*h* is preferably one third of the thickness of the interposition member 242 or below in consideration to cracks of the interposition member 242 generated when bending work is applied or due to slit ups during usage.

The wedge grooves 2421*e* of the external surface and the wedge grooves 2421*f* of the internal surface should at least be disposed in the following three positions. The positions are the vicinity of the upper end 2421*a*, the vicinity of the lower end 2421*b* and the vicinity of an intermediate part between the upper end 2421*a* and the lower end 2421*b*. In particular, in the case the angle formed by the pair of wall sections 2421 of the interposition member 242 against the floor part 2422 is larger than 90 degrees, effects to prevent positional displacements of each member and effects to prevent drop off are largely dependent upon the wedge grooves 2421*e* of the external surface and the wedge grooves 2421*f* of the internal surface disposed in the vicinity of the lower end 2421*b*.

The wedge grooves 2421*e* of the external surface and the wedge grooves 2421*f* of the internal surface should desirably be disposed so that they remain mutually misaligned. A constitution as such can prevent cracks or the like generated to the interposition member 242 during usage or bending work.

The length of the external surface wedge 2421*g* and the internal surface wedge 2421*h* is preferably 0.1 mm and below. Furthermore, in consideration of abrasion, the length is further preferably set to 0.07 mm and above. In addition, the interval between the external surface wedges 2421*g* and the interval between the internal surface wedges 2421*h* is set to 1 mm and below. The wedge grooves 2421*e* of the external surface are desirably misaligned for 0.3 mm and above against the wedge grooves 2421*f* of the internal surface. The wedge grooves 2421*e* of the external surface and the wedge grooves 2421*f* of the internal surface are preferably disposed in more than three positions.

The thickness of the pair of wall sections 2421 and the floor part 2422 of the interposition member 242 has differing adequate values according to the shape of the main body part 240. Increased thickness is advantageous for improving stiffness property, but desired magnetic force (for example, Ba illustrated in FIG. 4) by the rare earth magnet block 141 becomes difficult to be obtained if the thickness becomes too thick.

The same as the first embodiment, a plurality of fixed magnetic poles that generates magnetic force (illustrated in a frame format in FIG. 4 and includes the rare earth magnet block 141 as the image development magnetic pole with other components not illustrated) and an agent severance pole are disposed in the magnet roller 133B.

Next, an assembly method of the magnet roller 133B is described. First, the rare earth magnet block 141 is press-fitted into the concave portion 2423 of the interposition member 242 in a direction of an arrow S1 of FIG. 7 to be fixed thereof. At this moment, a bottom surface 141*b* and side surfaces 141*c* of the rare earth magnet block 141 are press-fitted to respectively come into contact with an upper surface 2422*a* and internal surfaces 2421*d* of the interposition member 242.

Next, the interposition member 242 press-fitted with the rare earth magnet block 141 is press-fitted into the main body groove 244 in a direction of an arrow S2 of FIG. 7 to be fixed thereof. At this moment, the press-fitting is performed so that the lower surface 2422*b* of the interposition member 242 comes into contact with the bottom surface 2442 of the main body groove 244 and the external surfaces 2421*c* of the interposition member 242 respectively come into contact with the pair of side surfaces 2441 of the main body groove 244.

Finally, fixed magnetic poles necessary for the image development roller 115 are magnetized by an electromagnet type magnetizing yoke. Thereby the magnet roller 133B is completed. In addition, in the present embodiment, each member is press-fitted to be fixed but it is not limited to such. For example, each member can be mutually fixed more strongly by combining use of an adhesive agent.

In the above-described assembly method (manufacturing method) of the magnet roller 133B, the interposition member 242 is press-fitted into the main body groove 244 after the rare earth magnet block 141 is press-fitted into the groove 2423 of the interposition member 242 so that the rare earth magnet block 141 is reinforced by the interposition member 242. Therefore, bending and damages generated when the rare earth magnet block 141 is press-fitted into the main body groove 244 can be prevented. Consequently, the assembly workability of the magnet roller 133B and the yield ratio of the rare earth magnet block 141 can be improved so that productivity can be heightened.

In addition, in the present embodiment, the main body part 240 is shaped to have an external diameter of 8.5 mm and an overall length of 313 mm. The main body groove 244 is shaped to have a length of 313 mm. In the main body groove, the bottom surface 2442 is shaped to have a width of 2.7 mm, the pair of side surfaces 2441 is shaped to have a height of 2.4 mm. In addition, the interposition member 242 is shaped to have a length of 313 mm and a thickness of 0.3 mm. In the interposition member 242, the width of the floor part 2422 is shaped to 2.6 mm and the height of the pair of wall sections 2421 is shaped to 2.3 mm. The pair of wall sections 2421 is shaped to have a 90 degree angle against the floor part 2422. The external surface wedge 2421*g* and the internal surface wedge 2421*h* are shaped to have a length of 0.1 mm. The interval of the external surface wedge 2421*g* and the interval of the internal surface wedge 2421*h* are shaped to 0.6 mm. Positional displacements (misalignment) between the wedge groove 2421*e* of the external surface and the wedge groove 2421*f* of the internal surface are shaped to 0.3 mm. The rare earth magnet block 141 is shaped to have a width of 2.0 mm, a height of 2.4 mm and a length of 313 mm. Each of these dimensions is only an example and can be adequately determined according to constitutions or the like.

As described above, according to the present invention, the interposition member 242 with a "U" character shaped cross-sectional surface is fixed in the main body groove 244 of the cylindrical column-like shaped main body part 240. The rare earth magnet block 141 is fixed to the concave portion 2423 of the interposition member 242 so that the main body part 240 is reinforced by the interposition member 242 and stiffness property of the main body part 240 can be heightened. Therefore, even in the case the main body part 240 is shifted to a smaller diameter (that is, smaller size), the stiffness property of the main body part 240 can be secured. Consequently, the magnet roller 133B can be provided with heightened stiffness property and smaller size.

In addition, the interposition member 242 is fixed in the main body groove 244 by press-fitting so that it is not necessary to use an adhesive agent for the fixture of the two members. Therefore, the interposition member 242 can be detached easily from the main body groove 244. Consequently, reuse of the interposition member 242 becomes possible and the magnet roller 133B can be provided at a cheap price. In addition, because an adhesive agent is not used for the fixture of the interposition member 242 and the main body groove 244, positional displacements of these members generated by the thickness of the adhesive agent or due to the drying of the adhesive agent can be avoided. Therefore, high precision assembly is possible.

In addition, the rare earth magnet block 141 is fixed in the groove 2423 of the interposition member 242 by press-fitting so that it is not necessary to use an adhesive agent for the fixture of the two members. Therefore, the rare earth magnet block 141 can be detached easily from the interposition member 242. Consequently, reuse of the expensive rare earth magnet block 141 becomes possible and the magnet roller 133B can be provided at a cheap price. In addition, because an adhesive agent is not used for the fixture of the interposition member 242 and the rare earth magnet block 141, positional displacements of these members generated by the thickness of the adhesive agent or due to the drying of the adhesive agent can be avoided. Therefore, high precision assembly is possible.

In addition, the interposition member 242 includes, in the external surface 2421*c* of the pair of wall sections 2421, wedge grooves 2421*e* of the external surface directed from the upper end 2421*a* towards the lower end 2421*b* and shaped to form an acute angle thereof. Besides, external surfaces 2421*c* of the pair of wall sections 2421 are respectively shaped to closely contact the pair of side surfaces 2441 of the main body groove 244. By disposing the wedge grooves 2421*e* of the external surface, the external surface wedges 2421*g* directed from the lower end 2421*b* towards the upper end 2421*a* of the pair of wall sections 2421 are shaped. Consequently, when the interposition member 242 is press-fitted into the main body groove 244, without the external surface wedges 2421*g*, the interposition member 242 is likely to drop off from the main body groove 242 in a direction. However, with the external surface wedges 2421*g*, the external surface wedges 2421*g* are caught by the pair of side surfaces 2441 of the main body groove 244 against the drop off direction so that each of these members is fixed more reliably. Therefore, drop off of the interposition member 242 from the main body groove 244 and positional displacements thereof can be prevented more reliably. The image development device or the like breaks down due to the drop off of the interposition member 242. Hence the magnet roller 133B with high reliability that can prevent such breakdowns is provided.

In addition, the pair of wall sections 2421 in the interposition member 242 is shaped to form an angle larger than 90 degrees against the floor part 2422 in the interposition member 242. Therefore, when the interposition member 242 is press-fitted into the main body groove 244, without the external surface wedges 2421*g*, the interposition member 242 is likely to drop off from the main body groove 242 in a direction. However, with the external surface wedges 2421*g* and the larger than 90 degrees angle formed by the pair of wall sections 2421, the external surface wedges 2421*g* are further strongly caught by the pair of side surfaces 2441 of the main body groove 244 against the drop off direction so that each of these members is fixed more reliably. Therefore, drop off of the interposition member 242 from the main body groove 244 and positional displacements thereof can be prevented more reliably. The image development device or the like breaks down due to the drop off of the interposition member 242. Hence the magnet roller 133B with high reliability that can prevent such breakdowns is provided.

In addition, the interposition member 242 includes, in the internal surface 2421*d* of the pair of wall sections 2421, wedge grooves 2421*f* of the internal surface directed from the lower end 2421*b* towards the upper end 2421*a* and shaped to form an acute angle thereof. Besides, internal surfaces 2421*d* of the pair of wall sections 2421 are respectively shaped to closely contact the side surfaces 141*c* of the rare earth magnet block 141. By disposing the wedge grooves 2421*f* of the internal surface, the internal surface wedges 2421*h* directed from the upper end 2421*a* towards the lower end 2421*b* of the pair of wall sections 2421 are shaped. Consequently, when the rare earth magnet block 141 is press-fitted into the interposition member 242, without the internal surface wedges 2421*h*, the rare earth magnet block 141 is likely to drop off from the interposition member 242 in a direction. However, with the internal surface wedges 2421*h*, the internal surface wedges 2421*h* are caught by the side surfaces 141*c* of the rare earth magnet block 141 against the drop off direction so that each of these members is fixed more reliably. Therefore, drop off of the rare earth magnet block 141 from the interposition member 242 and positional displacements thereof can be prevented more reliably. The image development device or the like breaks down due to the drop off of the rare earth magnet block 141. Hence the magnet roller 133B with high reliability that can prevent such breakdowns is provided.

In addition, the interposition member 242 is shaped using non-magnetic materials. In comparison to a case in which magnetic materials are used for the interposition member 242, peak magnetic flux density on the external surface of the image development roller 115 (a part of the external surface of the image development roller 115 corresponds to the position of the interposition member 242) can be heightened. Therefore, the developer agent can be more reliably supported on the external surface of the image development roller 115 and attachment of the developer agent to the photosensitive drum 108 or the like can be prevented.

In addition, non-magnetic metals are used for the interposition member 242 so that stiffness property of the magnet roller 133B can be further heightened.

In addition, by applying magnetic force (magnetic field) in a direction approximately parallel to the bottom surface 2442 of the groove 244 of the main body part and approximately orthogonal to the axial direction of the main body part, magnetic anisotropy is provided. Therefore, a point that shifts magnetic poles of the magnetic force (pole shift point) can be generated in the vicinity of the opening part of the groove so that magnetic force at this position can be lessened. Hence the developer agent attached to the magnetic particle support body can be cut at this position so that the developer agent drops off from the external surface of the image development roller 115. Consequently, rotations under a state in which the developer agent is ceaselessly adhering to the external surface of the image development roller 115 due to the magnetic particle support body can be prevented.

In addition, the magnet roller 133B includes the rare earth magnet block 141 that contains rare earth elements so that high magnetic force can be realized.

A Third Embodiment of the Magnetic Field Generating Member

Figure 8:
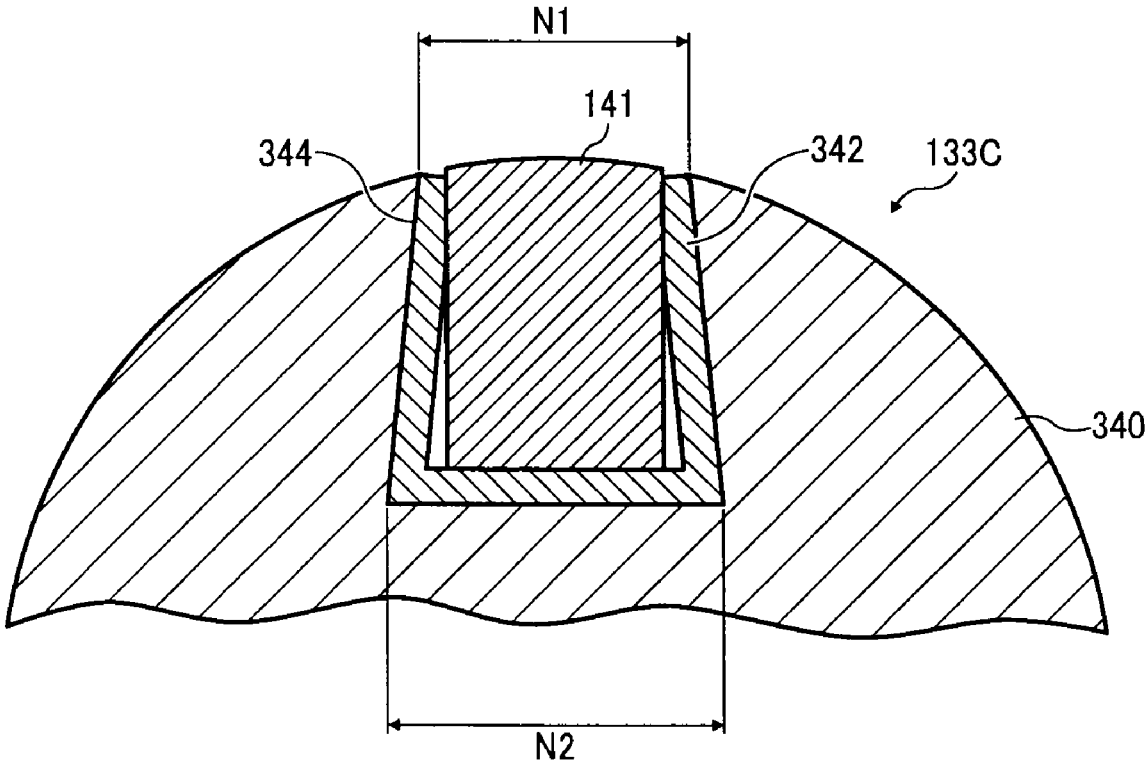
FIG. 8 is an enlarged cross-sectional diagram that illustrates a third embodiment of the magnet roller according to the present invention.
Figure 9:
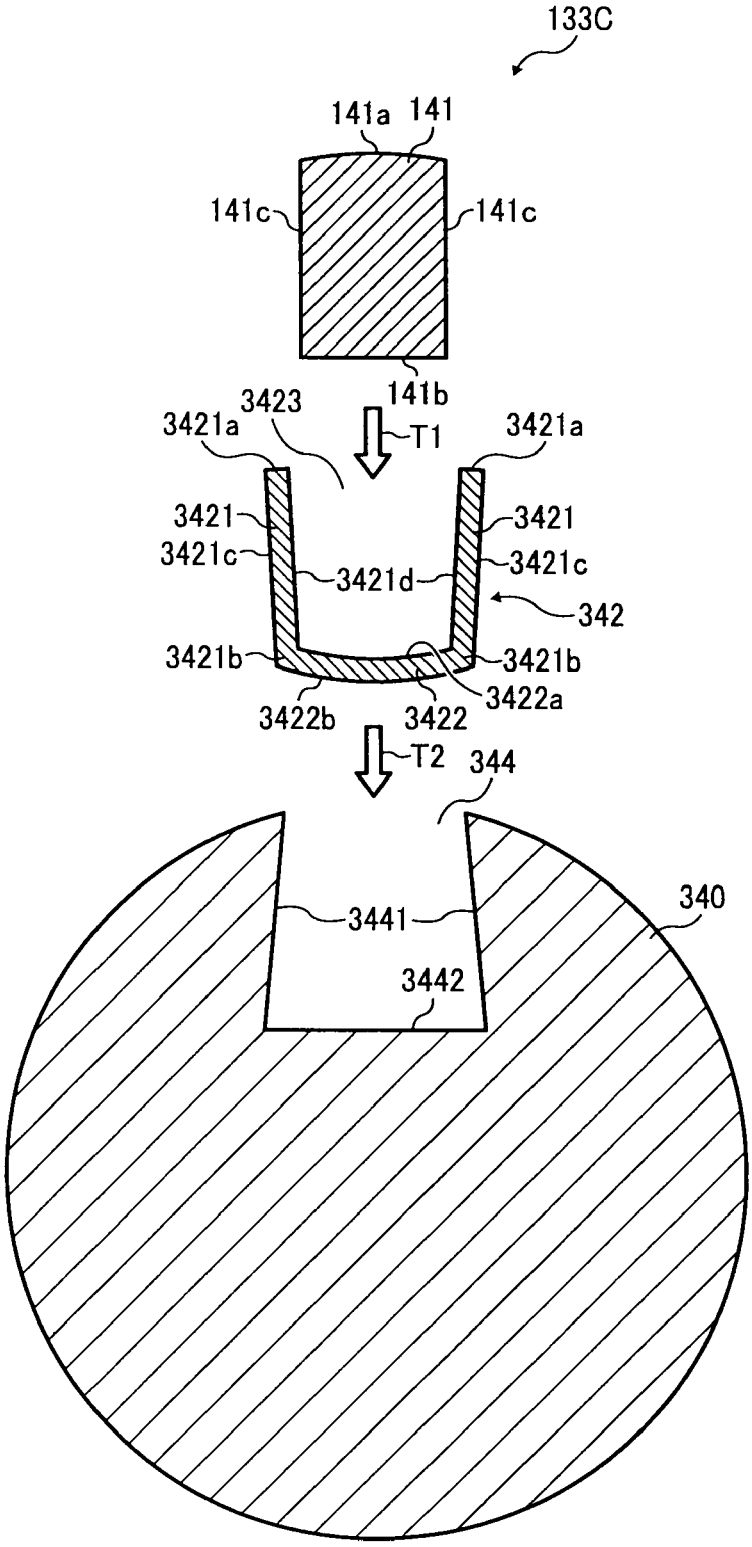
FIG. 9 is a cross-sectional diagram that illustrates an assembly method of the magnet roller of FIG. 8.
Figure 10:
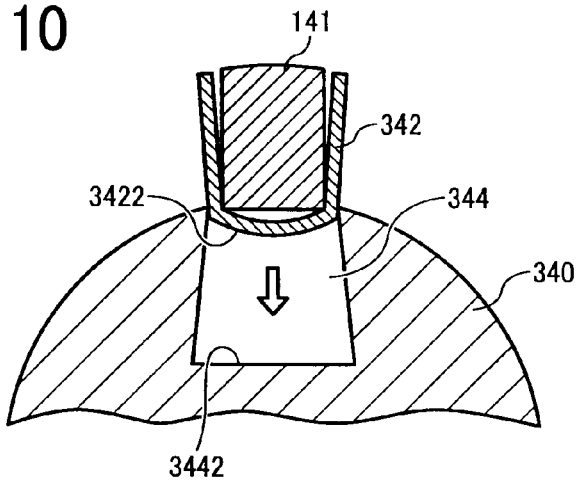
FIG. 10 is a cross-sectional diagram that illustrates a first shape of an interposition member in the magnet roller of FIG. 8.
Figure 11:
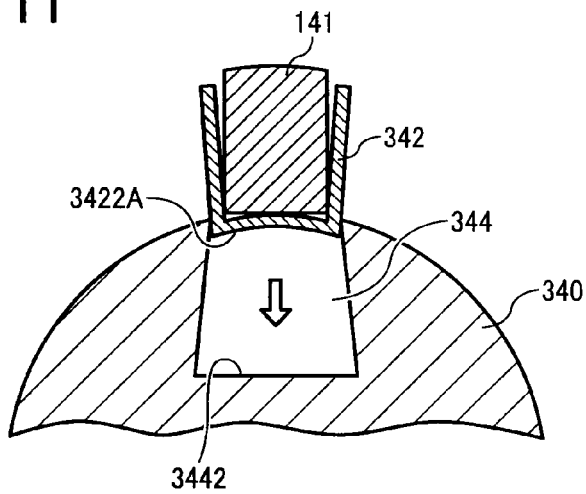
FIG. 11 is a cross-sectional diagram that illustrates a second shape of the interposition member in the magnet roller of FIG. 8.
Figure 12:
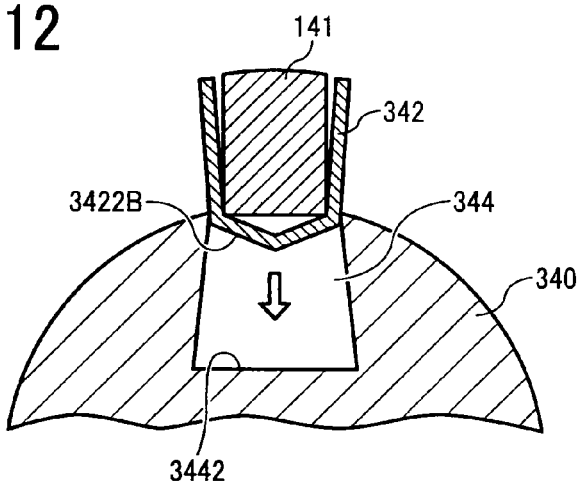
FIG. 12 is a cross-sectional diagram that illustrates a third shape of the interposition member in the magnet roller of FIG. 8.
Figure 13:
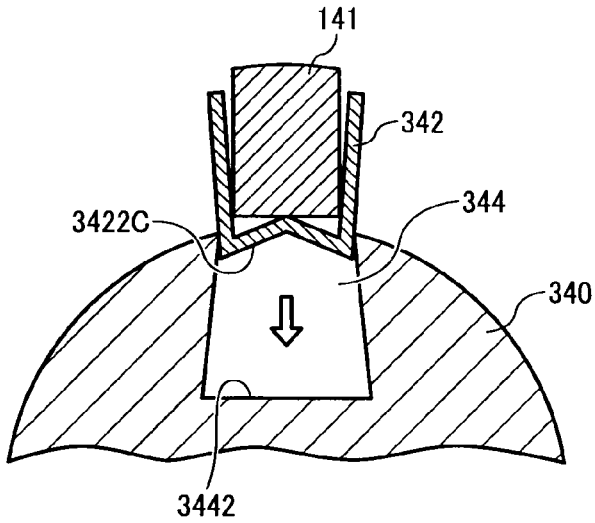
FIG. 13 is a cross-sectional diagram that illustrates a fourth shape of the interposition member in the magnet roller of FIG. 8.
Figure 14:
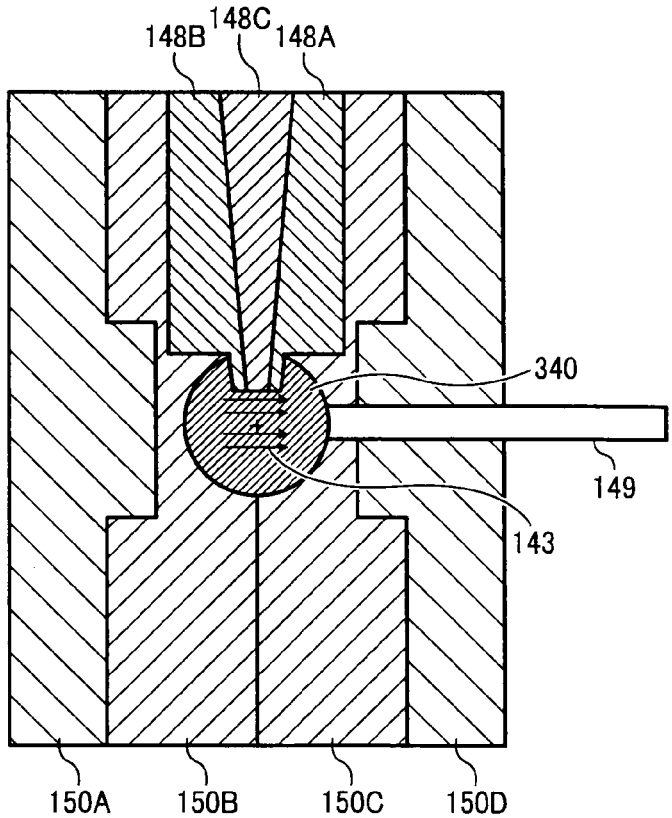
FIG. 14 is a cross-sectional diagram that illustrates an approximate structure of a metal mold that shapes the main body part of the magnet roller of FIG. 8.
Figure 15:
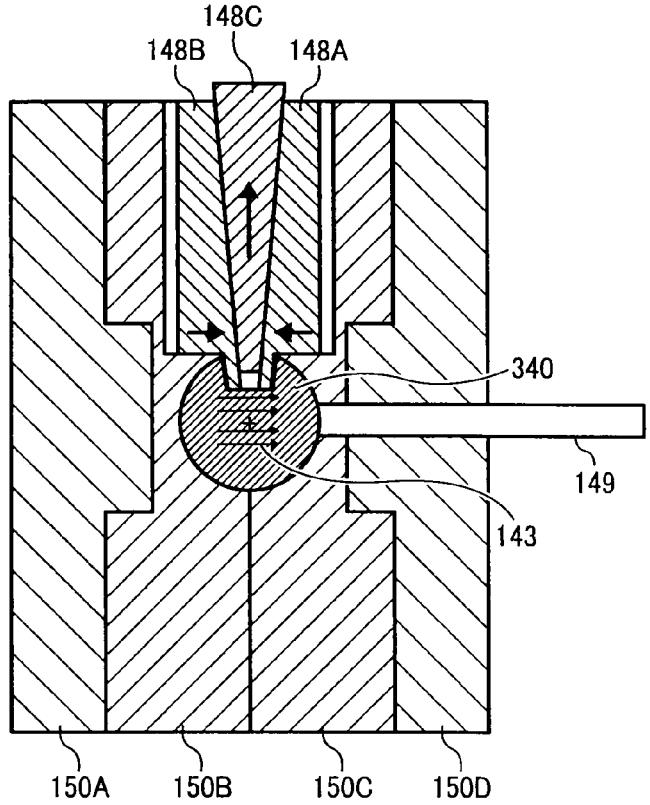
FIG. 15 is a cross-sectional diagram that illustrates a first part of the approximate operations of when the metal mold of FIG. 14 is detached from the mold.
Figure 16:
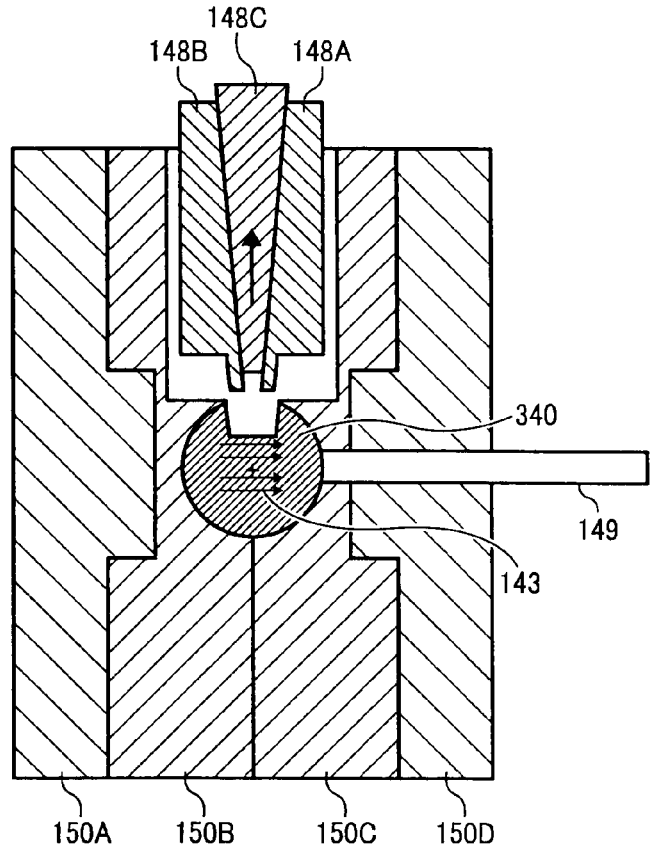
FIG. 16 is a cross-sectional diagram that illustrates a second part of the approximate operations of when the metal mold of FIG. 14 is detached from the mold.

FIG. 8 is an enlarged cross-sectional diagram that illustrates a third embodiment of a magnet roller according to the present invention. FIG. 9 is a cross-sectional diagram that illustrates an assembly method of the magnet roller of FIG. 8. FIG. 10 is a cross-sectional diagram that illustrates a first shape of an interposition member in the magnet roller of FIG. 8. FIG. 11 is a cross-sectional diagram that illustrates a second shape of the interposition member in the magnet roller of FIG. 8. FIG. 12 is a cross-sectional diagram that illustrates a third shape of the interposition member in the magnet roller of FIG. 8. FIG. 13 is a cross-sectional diagram that illustrates a fourth shape of the interposition member in the magnet roller of FIG. 8. FIG. 14 is a cross-sectional diagram that illustrates an approximate structure of a metal mold that shapes the main body part of the magnet roller of FIG. 8. FIG. 15 is a cross-sectional diagram that illustrates a first part of the approximate operations of when the metal mold of FIG. 14 is detached from the mold. FIG. 16 is a cross-sectional diagram that illustrates a second part of the approximate operations of when the metal mold of FIG. 14 is detached from the mold. Same reference numbers are assigned to parts with the same constitutions to the above-described first and second embodiments and descriptions of which are abbreviated hereby.

A magnet roller 133C of the present embodiment, as illustrated in FIG. 8, includes a main body part (main body) 340, an interposition member 342 and a magnetic member, for example, the rare earth magnet block 141 as the long magnetic compact.

The main body part 340 uses magnetic materials and is cylindrical column-like shaped. The same magnetic materials as the first and the second embodiments, that is, plastic magnet or rubber magnet can be used. A linear groove 344 provided in the main body 340 is disposed along a longitudinal direction on the external surface of the main body part 340. In addition, an axial part protruding from both end surfaces of the main body part 340 in the direction of the same axial is shaped in integration. In addition, in the main body part 340, a portion of the cylindrical column-like body can be cut along the axial direction so that a portion of the external surface is in plane shape.

The main body groove 344 is equal to the groove of the main body part described in the claims. A cross-section (lateral cross-section) of the main body groove 344 orthogonal to the axial direction of the main body part 340 is concave and approximately rectangular shaped in the external circumference surface of the main body part 340. The main body groove 344 is extended linearly along the longitudinal direction of the main body part 340 and disposed across the whole length of the main body part 340. In addition, the main body groove 344 is disposed to oppose a later described photosensitive drum 108 (that is, in a position of an image development magnetic pole) when the magnet roller 133C is incorporated into a later described image development device 113 (illustrated in FIG. 19).

The main body groove 344, as illustrated in FIG. 9, includes a pair of side surfaces 3441 and a bottom surface 3442.

The pair of side surfaces 3441 is two opposing plane parts shaped along the longitudinal direction of the main body groove 344 and to be approximately orthogonal against a width direction of an opening part. Each long side of the pair of side surfaces 3441 is respectively connected with the bottom surface 3442. The bottom surface 3442 is a plane part shaped along the longitudinal direction of the main body groove 344 and to be approximately parallel against the width direction of the opening part. An angle formed by the pair of side surfaces 3441 and the bottom surface 3442 is shaped to be smaller than 90 degrees. That is, the pair of side surfaces 3441 is reverse tapered shaped (undercut) so that a width N2 of the bottom surface 3442 is slightly larger than the width N1 of the opening part of the main body groove 344. That is, the main body groove 344 is dovetail joint shaped in which the width of the bottom surface 3442 is larger than the width of the opening part. Depth from the opening part of the main body groove 344 to the bottom surface 3442 (that is, depth of the main body groove 344) is determined according to specific constitutions but if the depth is too shallow, the height (the length of the short side direction) of a pair of wall sections 3421 of the later-described interposition member 342 becomes insufficient. Therefore, stiffening effects by the interposition member 342 cannot be obtained sufficiently.

The main body part 340 uses a metal mold of a structure illustrated in FIG. 14 and is manufactured by injection and magnetic field molding. The metal mold shapes the main body part 340. The main body groove 344 is shaped by disposing a slide piece 148A, a slide piece 148B and a slide piece 148C at the position of the metal mold. The slide piece 148A, the slide piece 148B and the slide piece 148C are constituted by a not illustrated "T" letter shaped groove structure. When injection molding is complete, the slide piece 148C, as illustrated in FIG. 15, moves in an upper direction. The slide piece 148A and the slide piece 148B movably assembled by the "T" letter shaped groove respectively move until a predetermined position in which the undercut of the main body groove 344 can be avoided. Thereafter, as illustrated in FIG. 16, the slide piece 148A, the slide piece 148B and the slide piece 148C in their entity move in the upper direction and shape the main body groove 344. Next, a nesting 150C and a nesting 150D of the movable side together with the slide piece 148A, the slide piece 148B and the slide piece 148C, the EJ (ejection) pin 149 and the main body part 340 move in the right direction inside FIG. 16 (mold opening). Next, the EJ pin 149 pushes out the main body part 340 (eject). Next, the EJ pin 149 is detached from the main body part 340 so that the main body part 340 can be obtained.

An orientated direction 143 of magnetic field (magnetic anisotropy) of the main body part 340, as illustrated in FIG. 3, in the case of one direction, is approximately parallel to the bottom surface 3442 of the main body groove 344 and approximately orthogonal to the axial direction. In the case of 4 equally divided poles also, one direction should desirably be parallel to the bottom surface 3442 of the main body groove 344 and orthogonal to the axial direction but it is not limited to such.

The interposition member 342 is obtained, for example, by shaping general plastic materials or by applying bending work to metal materials. Non-magnetic materials should be preferably used for either the plastic materials or the metal materials used for the interposition member 342. The rare earth magnet block 141 as the internal capsule has magnetic poles. When the interposition member 342 using non-magnetic materials is fixed in the main body groove 344, with regard to the magnetic poles, peak magnetic flux density on the external surface of the main body part 340 becomes higher so that the attachment of magnetic carrier 135 contained in the developer agent becomes advantageous.

In order to improve the stiffness property of the magnet roller 133C by the interposition member 342, the metal materials can be comparatively advantageously used for the interposition member 342. Within non-magnetic metal materials, spring materials of SUS301 are further advantageous from the viewpoints of property and cost. Within spring materials of SUS301, ½H (more than 310 HV) or ¾H (more than 370 HV) or H (more than 430 HV) or EH (more than 490 HV) is further desirable but the higher the hardness, the easier a crack can be generated to bent sections or the like during bending work so that attention is necessary.

The interposition member 342 is shaped to the same length as the main body groove 344. A cross-section of the short side direction of the interposition member 342 (that is, lateral cross-section) is "U" character shaped. The interposition member 342 includes a floor part 3422 and a pair of wall sections 3421. The rare earth magnet block 141 is fixed in a concave portion 3423 of the interposition member 342 by press-fitting. The concave portion 3423 of the interposition member 342 is shaped by the floor part 3422 and the pair of wall sections 3421. The concave portion 3423 is equal to a concave portion of an interposition member described in the claims.

Before the interposition member 342 is press-fitted into the main body groove 344, the width of the lower surface 3422*b* of the floor part 3422 is shaped to be smaller than the width of the opening part of the main body groove 344. After the interposition member 342 is press-fitted into the main body groove 344, the floor part 3422 is shaped to match the bottom surface 3442 of the main body groove 344 so that the two members cross over. Then, when the interposition member 342 is press-fitted into the main body groove 344 to be fixed thereof, the interposition member 342 is disposed so that its lower surface 3422*b* comes into contact with the bottom surface 3442 of the main body groove 344. Under such a constitution, the width of the floor part 3422 of the interposition member 342 becomes larger than the width of the opening part of the main body groove 344 after the press-fitting so that the interposition member 342 is caught by the pair of side surfaces 3441 (serves as stoppers) of the main body groove 344 and drop off of the interposition member 342 from the main body groove 344 can be prevented.

In addition, the kinds of shapes of the floor part 3422 can be various. For example, the lateral cross sectional surface of the floor part 3422 can be a concave "R" shaped floor part 3422 illustrated in FIG. 10, a convex "R" shaped floor part 3422A illustrated in FIG. 11, a "V" letter shaped floor part 3422B illustrated in FIG. 12 and a reverse "V" letter shaped floor part 3422C illustrated in FIG. 13 or the like. However, shapes of the floor part 3422 are not limited to these.

The pair of wall sections 3421 is rectangular flat plates disposed uprightly originating from a pair of mutually opposed long sides of the floor part 3422. The length (that is, height of the pair of wall sections 3421) from an upper end 3421*a* to a lower end 3421*b* of the pair of wall sections 3421 is shaped to be less or equal to the width of the pair of side surfaces 3441 of the main body groove 344 and preferably, to equal the width of the pair of side surfaces 3441 of the main body groove 344. When the interposition member 342 is press-fitted into the main body groove 344, external surfaces 3421*c* of the pair of wall sections 3421 are shaped to come into contact with the pair of side surfaces 3441.

The thickness of the floor part 3422 and the pair of wall sections 3421 of the interposition member 342 has differing adequate values according to the shape of the main body part 340. The floor part 3422 and the pair of wall sections 3421 should be advantageously thickened in order to improve stiffness property. But desired magnetic forces (for example, the Ba illustrated in FIG. 4) by the rare earth magnetic block 141 become difficult to obtain if the floor part 3422 and the pair of wall sections 3421 become too thick.

The same as the first and the second embodiments, a plurality of fixed magnetic poles that generates magnetic force (illustrated in a frame format in FIG. 4 and includes the rare earth magnet block 141 as the image development magnetic pole with other components not illustrated) and an agent severance pole are disposed in the magnet roller 133C.

Next, an assembly method of the magnet roller 133C is described. The rare earth magnet block 141 is press-fitted into the concave portion 3423 of the interposition member 342 in a direction of an arrow T1 of FIG. 9 while simultaneously the interposition member 342 is press-fitted into the main body groove 344 in a direction of an arrow T2 of FIG. 9. Then the floor part 3422 of the interposition member 342 reaches the bottom surface 3442 of the main body groove 344. Furthermore, the bottom surface 141*b* of the rare earth magnet block 141 is pressed against the floor part 3422. The floor part 3422 is extended in a flat plate shape along the bottom surface 3442 and the two respectively match and cross over. In addition, the external surface 3421*c* of the pair of wall sections 3421 of the interposition member 342 come into contact with the pair of side surfaces 3441 of the main body groove 344. The rare earth magnet block 141, the interposition member 342 and the main body part 340 are mutually fixed under a state in which the width of the floor part 3422 is larger than the width of the opening part of the main body groove 344.

Finally, fixed magnetic poles necessary for the image development roller 115 are magnetized by an electromagnet type magnetizing yoke. Thereby the magnet roller 133C is completed. In addition, in the present embodiment, each member is press-fitted to be fixed but it is not limited to such. For example, each member can be mutually fixed more strongly by combining use of an adhesive agent.

In the above-described assembly method (manufacturing method) of the magnet roller 133C, the rare earth magnet block 141 is press-fitted into the concave portion 3423 of the interposition member 342 while simultaneously the interposition member 342 is press-fitted into the main body groove 344 so that the rare earth magnet block 141 is reinforced by the interposition member 342. Therefore, bending and damages generated when the rare earth magnet block 141 is press-fitted into the main body groove 344 can be prevented. Consequently, the assembly workability of the magnet roller 133C and the yield ratio of the rare earth magnet block 141 can be improved so that productivity can be heightened.

In addition, in FIG. 8, there seemingly is a gap between the rare earth magnet block 141 and the interposition member 342 but actually, only an extremely minute gap exists between the two members.

In addition, in the present embodiment, the main body part 340 is shaped to have an external diameter of 8.5 mm and an overall length of 313 mm. The main body groove 344 is shaped to have a length of 313 mm. In the main body groove, the bottom surface 3442 is shaped to have a width of 2.7 mm, a distance from an axial center to the bottom surface 3442 is 1.85 mm, the width of the opening part of the main body groove 344 is 2.31 mm and angles formed between the bottom surface 3442 and the pair of side surfaces 3441 are shaped to 85 degrees. In addition, the interposition member 342 is shaped to have a length of 313 mm and a thickness of 0.3 mm. In the interposition member 342, the width of the side of the upper surface 3422*a* of the floor part 3422 is shaped to 1.6 mm and the height of the side of the internal surface 3421*d* of the pair of wall sections 3421 is shaped to 1.92 mm. The floor part 3422 is concave "R" shaped (FIG. 10). The rare earth magnet block 141 is shaped to have a width of 2.0 mm, a height of 2.4 mm and a length of 313 mm. Each of these dimensions is only an example and can be adequately determined according to constitutions or the like.

As described above, according to the present invention, the interposition member 342 with a "U" character shaped cross sectional surface is fixed in the main body groove 344 of the cylindrical column-like shaped main body part 340. The rare earth magnet block 141 is fixed in the groove 3423 of the interposition member 342 so that the main body part 340 is reinforced by the interposition member 342 and stiffness property of the main body part 340 can be heightened. Therefore, even in the case the main body part 340 is shifted to a smaller diameter (that is, smaller size), the stiffness property of the main body part 340 can be secured. Consequently, the magnet roller 133C can be provided with heightened stiffness property and smaller size.

In addition, the interposition member 342 is fixed in the main body groove 344 by press-fitting so that it is not necessary to use an adhesive agent for the fixture of the two members. Therefore, the interposition member 342 can be detached easily from the main body groove 344. Consequently, reuse of the interposition member 342 becomes possible and the magnet roller 133C can be provided at a cheap price. In addition, because an adhesive agent is not used for the fixture of the interposition member 342 and the main body groove 344, positional displacements of these members generated by the thickness of the adhesive agent or due to the drying of the adhesive agent can be avoided. Therefore, high precision assembly is possible.

In addition, the rare earth magnet block 141 is fixed in the concave portion 3423 of the interposition member 342 by press-fitting so that it is not necessary to use an adhesive agent for the fixture of the two members. Therefore, the rare earth magnet block 141 can be detached easily from the interposition member 342. Consequently, reuse of the expensive rare earth magnet block 141 becomes possible and the magnet roller 133C can be provided at a cheap price. In addition, because an adhesive agent is not used for the fixture of the interposition member 342 and the rare earth magnet block 141, positional displacements of these members generated by the thickness of the adhesive agent or due to the drying of the adhesive agent can be avoided. Therefore, high precision assembly is possible.

In addition, the main body groove 344 is reverse tapered shaped (dovetail joint shaped) in which the width of the bottom surface 3422 is larger than the width of the opening part. When the interposition member 342 is press fitted into the main body groove 344, because the width of the lower surface 3422*b* of the interposition member 342 is shaped to be larger than the width of the opening part of the main body groove 344, the interposition member 342 is caught by the opening part of the main body groove 344 so that the interposition member 342 can be fastened within the main body groove 344 to be fixed thereof. Therefore, drop off of the interposition member 342 from the main body groove 344 can be prevented more reliably. The image development device or the like breaks down due to the drop off of the interposition member 342. Hence the magnet roller 133C with high reliability that can prevent such breakdowns is provided.

In addition, the interposition member 342 is shaped using non-magnetic materials. In comparison to a case in which magnetic materials are used for the interposition member 342, peak magnetic flux density on the external surface of the image development roller 115 (a part of the external surface of the image development roller 115 corresponds to the position of the interposition member 342) can be heightened. Therefore, the developer agent can be more certainly supported on the external surface of the image development roller 115 and attachment of the developer agent to the photosensitive drum 108 or the like can be prevented.

In addition, non-magnetic metals are used for the interposition member 342 so that stiffness property of the magnet roller 133C can be further heightened.

In addition, by applying magnetic force (magnetic field) in a direction approximately parallel to the bottom surface 3442 of the groove 344 of the main body part and approximately orthogonal to the axial direction of the main body part, magnetic anisotropy is provided. Therefore, a point that shifts magnetic poles of the magnetic force (pole shift point) can be generated in the vicinity of the opening part of the groove so that magnetic force at this position can be lessened. Hence the developer agent attached to the magnetic particle support body can be cut at this position so that the developer agent drops off from the external surface of the image development roller 115. Consequently, rotations under a state in which the developer agent is ceaselessly adhering to the external surface of the image development roller 115 due to the magnetic particle support body can be prevented.

In addition, the magnet roller 133C includes the rare earth magnet block 141 that contains rare earth elements so that high magnetic force can be realized.

An Embodiment of a Magnetic Particle Support Body

Figure 18:
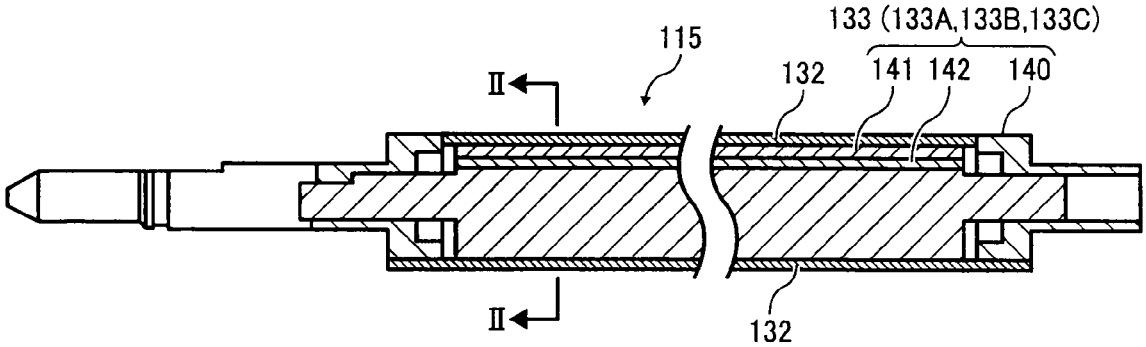
FIG. 18 is a cross-sectional diagram that illustrates an embodiment of an image development roller according to the present invention.

FIG. 18 is a cross-sectional diagram that illustrates an embodiment of an image development roller as a magnetic particle support body according to the present invention.

The later-described image forming apparatus 101 (illustrated in FIG. 20) includes an image development device 113 (illustrated in FIG. 19). The image development roller 115 of the present embodiment is incorporated in the image development device 113. The image development roller 115 supports developer agent on its external surface and delivers the developer agent to an image development area 131. A photosensitive drum 108 has electrostatic images formed on its surface. The image development area 131 opposes the photosensitive drum 108.

The image development roller 115, as illustrated in FIG. 18, includes one of the magnet rollers 133A, 133B and 133C (magnet roller 133 hereinbelow) illustrated in the above described first, second and third embodiments as a magnetic field generating member. The image development roller 115 also includes a cylindrical shaped image development sleeve 132 shaped so that the magnet roller 133 becomes an internal capsule. In addition, in the image development roller 115, a cored bar conventionally present is not illustrated but it is not problematic even the cored bar is present. However, magnet volumes of the magnet roller 133 decrease due to the cored bar and magnetic force thereof is weakened. Therefore, countermeasures that compensate this phenomenon are necessary.

The image development sleeve 132 is equal to a hollow body described in the claims. The image development sleeve 132 is shaped so that the magnet roller 133 becomes an internal capsule (contained within). The image development sleeve 132 is disposed freely rotatable around an axial core. The image development sleeve 132 is rotated so that its internal circumference surface opposes fixed magnetic poles in a sequence. The external surface of the image development sleeve 132 is applied roughen processing (SWB) so that many concavities are disposed thereon. The plane shape of the concavities is ellipsoidal. A plurality of (many) concavities (the concavities just described) are disposed randomly on the external surface of the image development sleeve 132. Needless to say, the concavities include those whose longitudinal direction is along the axial direction of the image development sleeve 132 and those whose longitudinal direction is along the circumference direction of the image development sleeve 132. The concavities whose longitudinal direction is along the axial direction of the image development sleeve 132 are more than the concavities whose longitudinal direction is along the circumference direction of the image development sleeve 132. Furthermore, the length (long diameter) of the longitudinal direction of the concavities is greater or equal to 0.05 mm and less or equal to 0.3 mm. The width (diameter at end) of the width direction is greater or equal to 0.02 mm and less or equal to 0.1 mm.

Aluminum, SUS (stainless) or the like can be used as the materials for the image development sleeve 132. Aluminum is used more often from the viewpoints of workability and lightness. In the case of aluminum, A6063, A5056 and A3003 or the like can be used. In the case of SUS, 303, 304 and 316 or the like can be used.

As described above, the present invention includes one of the magnet rollers 133A, 133B and 133C illustrated in the above described first, second and third embodiments as the magnetic field generating member so that the image development roller 115 of a smaller size can be provided.

An Embodiment of an Image Development Device

Figure 19:
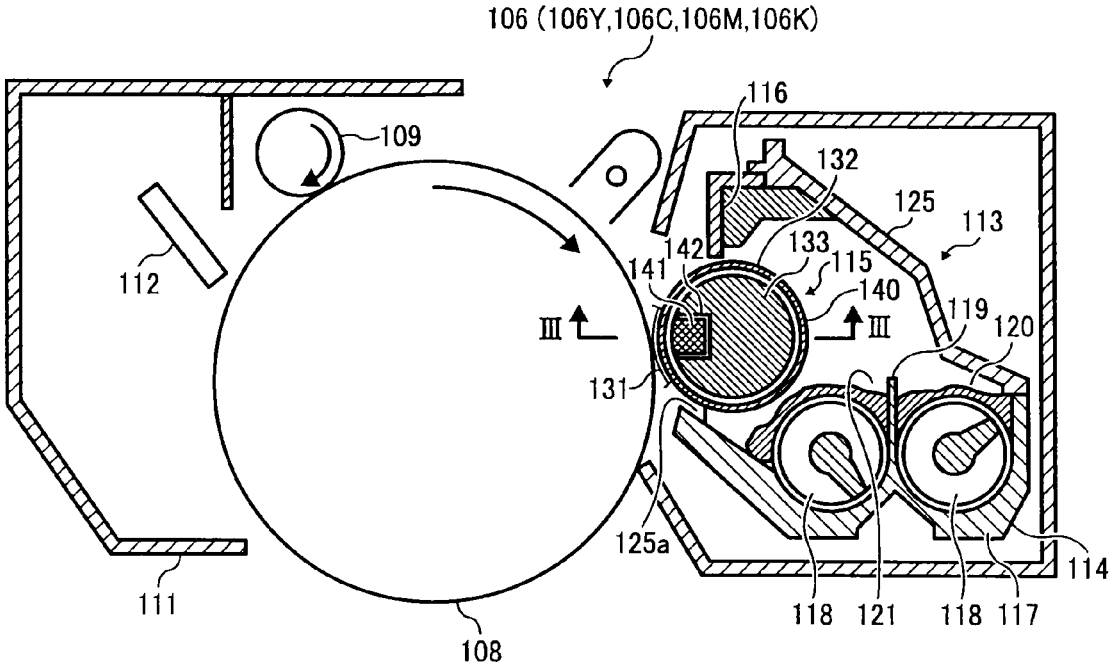
FIG. 19 is a cross-sectional diagram that illustrates an embodiment of a process cartridge and an image development device according to the present invention.

FIG. 19 is a cross-sectional diagram that illustrates an embodiment of a process cartridge and an image development device according to the present invention.

The image development device 113 of the present embodiment, as illustrated in FIG. 19, includes at least a developer agent supply part 114, a case 125, the above described image development roller 115 and a developer agent control blade 116 as a developer agent control member.

The developer agent supply part 114 includes a holding tank 117 and a pair of stirring screws 118 as a stirring member. The holding tank 117 is box shaped with an approximate same length to the photosensitive drum 108. In addition, a partition 119 extended along the longitudinal direction of the holding tank 117 is disposed within the holding tank 117. The partition 119 compartments the space within the holding tank 117 into a first space 120 and a second space 121. In addition, both end parts of the first space 120 and the second space 121 are mutually connected.

The holding tank 117 contains developer agent in both the first space 120 and the second space 121. The developer agent includes magnetic carrier 135 and toner. The toner is adequately supplied to one end part of the first space 120. The first space 120 is situated at a side remote from the image development roller 115 in comparison to the second space 121. The toner is spherical minute particles manufactured by the emulsion polymerization method or the suspension polymerization method. In addition, the toner can be obtained by crushing a lump constituted from synthetic resin in which various dye compounds or colorants are mixed and dispersed. The average particle diameter of the toner is greater or equal to 3 μm and less or equal to 7 μm. In addition, the toner can be shaped by a crush processing.

Figure 17:
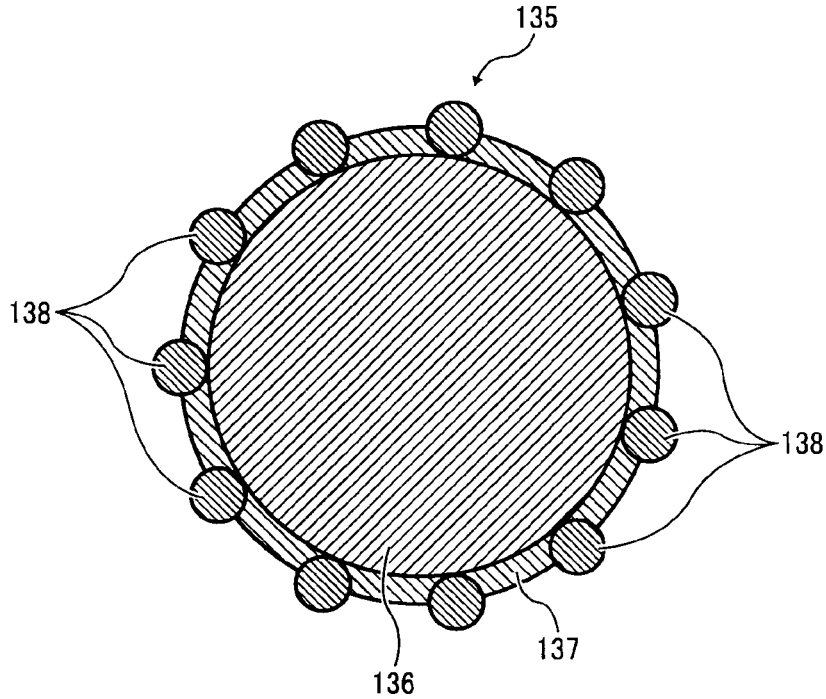
FIG. 17 is a cross-sectional diagram of magnetic carriers contained in a developer agent.

The magnetic carrier 135 is contained in both the first space 120 and the second space 121. The average particle diameter of the magnetic carrier 135 is greater or equal to 20 μm and less or equal to 50 μm. The magnetic carrier, as illustrated in FIG. 17, includes a wicking 136 as the material for the core, a resin coating membrane 137 covering the external surface of the wicking 136 and a plurality of alumina particle 138 dispersed by the resin coating membrane 137.

Ferrite is a magnetic material. The spherical shaped wicking 136 is constituted from ferrite. The external surface of the wicking 136 is covered by the resin coating membrane 137 in its entirety. The resin coating membrane 137 contains an electrical-charged adjustment agent and a resin component obtained by cross-linking thermal plastic resins of acryl or the like with melamine resin. The resin coating membrane 137 has elasticity and strong adhesive force. The alumina particles 138 are spherical shaped with an external diameter larger than the thickness of the resin coating membrane 137. The alumina particles 138 are held by the strong adhesive force of the resin coating membrane 137. The alumina particles 138 are protruding more towards the external circumference side of the magnet carrier 135 in comparison to the resin coating membrane 137.

The first space 120 and the second space 121 respectively contain the stirring screw 118. The longitudinal direction of the stirring screw 118 is parallel to the longitudinal direction of the holding tank 117, the image development roller 115 and the photosensitive drum 108. The stirring screw 118 is disposed freely rotatable around the axial core. The stirring screw 118 stirs the magnetic carrier 135 and the toner by rotating around the axial core and delivers the developer agent along the axial core.

In the illustrated example, the stirring screw 118 within the first space 120 delivers the developer agent from the above described one end part towards the other end part. The stirring screw 118 within the second space 121 delivers the developer agent from the other end part towards the one end part.

According to the above-described constitution, the developer agent supply part 114 stirs the toner supplied to the one end part of the first space 120 with the magnetic carrier 135 and delivers the toner to the other end part. The developer agent is then delivered from the other end part of the first space 120 to the other end part of the second space 121. Then the developer agent supply part 114 stirs the toner and the magnetic carrier 135 within the second space 121. The developer agent supply part 114 then delivers the developer agent in the axial core direction and supplies the developer agent to the external surface of the image development roller 115.

The box shaped case 125 is fixed on the holding tank 117 of the above described developer agent supply part 114 and covers the image development roller 115 or the like together with the holding tank 117. In addition, an opening part 125*a* is disposed in a part of the case 125. The part opposes the photosensitive drum 108.

The above-described image development roller 115 is disposed in the vicinity of the above-described opening part 125*a* and also between the second space 121 and the photosensitive drum 108. The image development roller 115 is parallel to both the photosensitive drum 108 and the holding tank 117. The image development roller 115 is disposed having an interval with the photosensitive drum 108.

The developer agent control blade 116 is disposed in an end part of the image development device 113 close to the photosensitive drum 108. The developer agent control blade 116 is fixed on the above-described case 125 in a state having an interval with the external surface of the image development sleeve 132. The developer agent control blade 116 trim off the developer agent on the external surface of the image development sleeve 132 exceeding the desired thickness into the holding tank 117 so that the developer agent on the external surface of the image development sleeve 132 is delivered to the image development area 131 in desired thickness.

In the image development device 113, the toner and the magnetic carrier 135 are sufficiently stirred by the developer agent supply part 114. The stirred developer agent is adsorbed onto the external surface of the image development sleeve 132 by the fixed magnetic poles. Then the image development sleeve 132 is rotated so that the developer agent adsorbed by the plurality of fixed magnetic poles is delivered towards the image development area 131. Then the developer agent shifted into the desired thickness by the developer agent control blade 116 is adsorbed onto the photosensitive drum 108 by the image development device 113. In such a way, the image development device 113 supports the developer agent to the image development roller 115 and delivers the developer agent to the image development area 131. Then an electrostatic latent image on the photosensitive drum 108 is developed by the image development device 113 so that a toner image is formed.

Then the after image development developer agent is detached towards the holding tank 117 by the image development device 113. Then the after image development developer agent held in the holding tank 117 is again sufficiently stirred with other developer agent within the second space 121 to be used for development of an electrostatic latent image of the photosensitive drum 108.

As described above, the present invention includes the above described image development roller 115 so that the image development device 113 of a smaller size can be provided.

An Embodiment of a Process Cartridge

Figure 20:
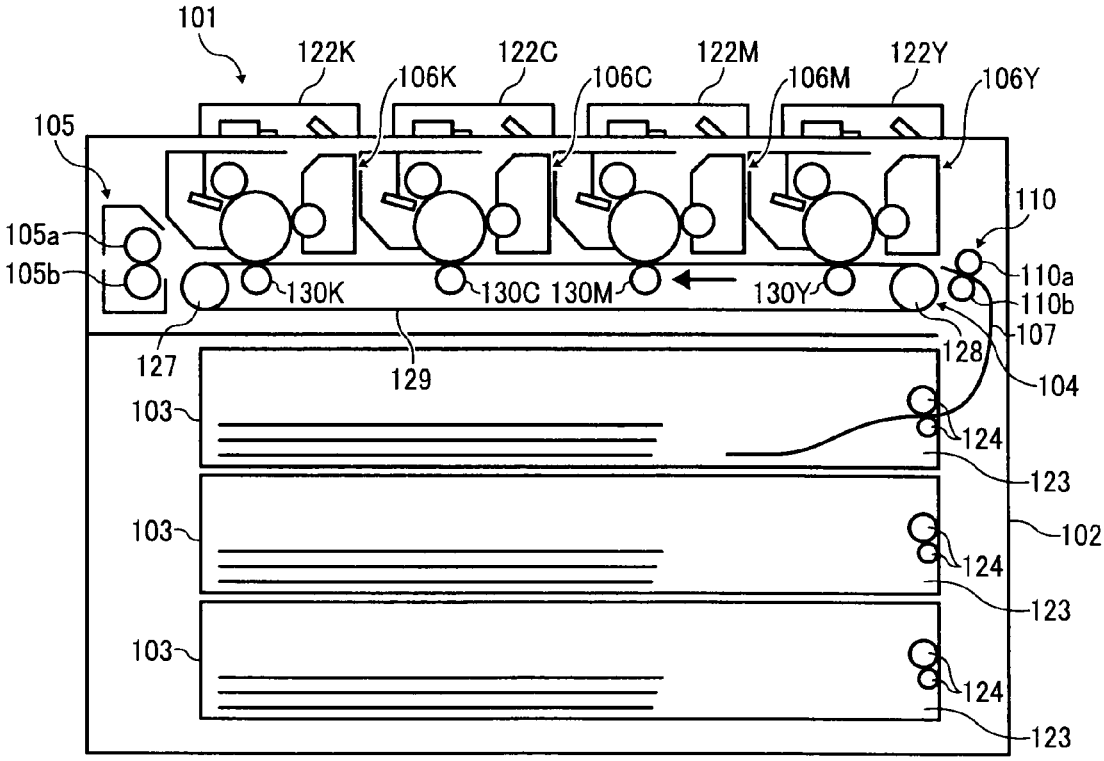
FIG. 20 is a cross-sectional diagram that illustrates an embodiment of an image forming apparatus according to the present invention.

FIG. 19 is a cross-sectional diagram that illustrates an embodiment of a process cartridge and an image development device according to the present invention. FIG. 20 is a cross-sectional diagram that illustrates an embodiment of an image forming apparatus according to the present invention.

A process cartridge 106 of the present embodiment, as illustrated in FIG. 19, includes a cartridge case 111, an electrical-charged device such as an electrical-charged roller 109, an electrostatic latent image support body such as a photosensitive drum 108, a cleaning device such as a cleaning blade 112 and the above described image development device 113. Therefore, the image forming apparatus 101 includes at least the electrical-charged roller 109, the photosensitive drum 108, the cleaning blade 112 and the image development device 113.

The cartridge case 111 is freely detachable from an apparatus main body 102 of the image forming apparatus 101. The electrical-charged roller 109, the photosensitive drum 108, the cleaning blade 112 and the image development device 113 are held in the cartridge case 111. The external surface of the photosensitive drum 108 is electrically charged uniformly by the electrical-charged roller 109. The image development device 113 includes the above-described image development roller 115. The photosensitive drum 108 is disposed having an interval with the image development roller 115. The photosensitive drum 108 is cylindrical column-like shaped or cylindrical shaped. The photosensitive drum is freely rotatable with an axial core as the center. Electrostatic latent images are formed on the external surface of the photosensitive drum 108 by corresponding laser writing units of 122Y, 122M, 122C and 122K. The electrostatic latent images are also supported by the photosensitive drum 108. Toner is adsorbed onto the electrostatic latent images so that the electrostatic latent images are developed. A toner image obtained as such is transferred onto a piece of recording paper 107. The recording paper 107 is positioned between the photosensitive drum 108 and a delivery belt 129. The cleaning blade 112 removes residual toners remaining on the external surface of the photosensitive drum 108 after the toner image is transferred onto the recording paper 107.

As described above, the present invention includes the above-described image development device 113 so that the process cartridge 106 of a smaller size can be provided.

An Embodiment of an Image Forming Apparatus

FIG. 20 is a cross-sectional diagram that illustrates an embodiment of an image forming apparatus according to the present invention.

The image forming apparatus 101 forms on a piece of the recording paper 107 as a transfer material color images, that is, images of each color of yellow (Y), magenta (M), cyan (C) and black (K). In addition, units or the like corresponding to each color of yellow (Y), magenta (M), cyan (C) and black (K) are illustrated hereinbelow with Y, M, C and K attached to the end of the respective reference numbers.

The image forming apparatus 101, as illustrated in FIG. 20, includes at least the apparatus main body 102, a paper feeding unit 103, a pair of resist roller 110, a transfer unit 104, a fixing unit 105, a plurality of laser writing units 122Y, 122M, 122C and 122K as well as a plurality of process cartridges 106Y, 106M, 106C and 106K.

The apparatus main body 102 is for example, box shaped and can be disposed on a floor or the like. The paper feeding unit 103, the pair of resist roller 110, the transfer unit 104, the fixing unit 105, the plurality of laser writing units 122Y, 122M, 122C and 122K as well as the plurality of process cartridges 106Y, 106M, 106C and 106K are held in the apparatus main body 102.

The above-described process cartridges 106Y, 106M, 106C and 106K correspond to each color respectively and are disposed between the transfer unit 104 and the laser writing units 122Y, 122M, 122C and 122K. The process cartridges 106Y, 106M, 106C and 106K are freely detachable from the apparatus main body 102. The process cartridges 106Y, 106M, 106C and 106K are disposed in parallel along the delivery direction of the recording paper 107.

A plurality of the paper feeding unit 103 is disposed in the lower part of the apparatus main body 102. The above-described recording paper 107 is held and stacked in layers in the paper feeding unit 103. The paper feeding unit 103 includes a plurality of paper feeding cassette 123 and a plurality of paper feeding roller 124. The paper feeding cassette 123 can be taken freely in and out of the apparatus main body 102. The paper feeding roller 124 is pressed against the uppermost piece of recording paper 107 within the paper feeding cassette 123. The paper feeding roller 124 sends out the above-described uppermost piece of recording paper 107 into a delivery path between the photosensitive drum 108 and a later described delivery belt 129. The transfer unit 104 includes the later-described delivery belt 129. The process cartridges 106Y, 106M, 106C and 106K include the photosensitive drum 108.

The recording paper 107 is delivered from the paper feeding unit 103 to the transfer unit 104. The pair of resist rollers 110 is disposed in the delivery path of the recording paper 107. The pair of resist rollers 110 includes a pair of rollers 110*a* and 110*b*. The recording paper 107 is interleaved between the pair of rollers 110*a* and 110*b*. The interleaved recording paper 107 is then sent out into the delivery path between the transfer unit 104 and the process cartridges 106Y, 106M, 106C and 106K by the pair of resist roller 110 in a timing that can be superimposed with a toner image.

The transfer unit 104 is disposed above the paper feeding unit 103. The transfer unit 104 includes a drive roller 127, a driven roller 128, the delivery belt 129, transfer rollers 130Y, 130M, 130C and 130K. The drive roller 127 is disposed in a downstream side of the delivery direction of the recording paper 107. The drive roller 127 is rotary driven by a drive source such as a motor or the like. The driven roller 128 is supported by the apparatus main body 102. The driven roller 128 is freely rotatable and is disposed in an upstream side of the delivery direction of the recording paper 107. The delivery belt 129 is circularly shaped with no end and encircles both the above described drive roller 127 and the driven roller 128. The delivery belt 129 is rotary driven by the drive roller 127 and circulates around the above described drive roller 127 and the driven roller 128 in a counter clock-wise direction in the figure (run with no end).

The delivery belt 129 and the recording paper 107 on the delivery belt 129 are interleaved between the photosensitive drum 108 of the process cartridges 106Y, 106M, 106C and 106K and the respective transfer rollers 130Y, 130M, 130C and 130K. The transfer rollers 130Y, 130M, 130C and 130K press the recording paper 107 sent out from the paper feeding unit 103 onto the external surface of the photosensitive drum 108 of each of the process cartridges 106Y, 106M, 106C and 106K so that the toner image on the photosensitive drum 108 is transferred to the recording paper 107. The transfer unit 104 sends out the recording paper 107 transferred with the toner image towards the fixing unit 105.

The fixing unit 105 is disposed downstream in the delivery direction of the recording paper 107 delivered by the transfer unit 104. The fixing unit 105 includes a pair of rollers 105*a* and 105*b*. The recording paper 107 is interleaved between the pair of rollers 105*a* and 105*b*. The fixing unit 105 presses and heats the recording paper 107 sent out from the transfer unit 104 between the pair of rollers 105*a* and 105*b* so that the toner image transferred onto the recording paper 107 from the photosensitive drum 108 is fixed on the recording paper 107.

The laser writing units 122Y, 122M, 122C and 122K are respectively fixed on the upper part of the apparatus main body 102. Each of the laser writing units 122Y, 122M, 122C and 122K respectively corresponds to one of the process cartridges 106Y, 106M, 106C and 106K. The process cartridges 106Y, 106M, 106C and 106K include the electrical-charged roller 109. The photosensitive drum 108 is electrical-charged uniformly by the electrical-charged roller 109. The laser writing units 122Y, 122M, 122C and 122K irradiate (project) laser beams onto the external surface of the photosensitive drum 108 to form an electrostatic latent image.

The image forming apparatus 101, as illustrated hereinbelow, forms an image on the recording paper 107. First, the image forming apparatus 101 rotates the photosensitive drum 108 so that the external surface of the photosensitive drum 108 is electrical-charged uniformly by the electrical-charged roller 109. Next, laser beams are irradiated (projected) onto the external surface of the photosensitive drum 108 so that an electrostatic latent image is formed on the external surface of the photosensitive drum 108. Then when the electrostatic latent image is positioned in the image development area 131, the developer agent adsorbed onto the external surface of the image development sleeve 132 of the image development device 113 is adsorbed onto the external surface of the photosensitive drum 108 so that the electrostatic latent image is developed and a toner image is formed on the external surface of the photosensitive drum 108.

Then when the recording paper 107 delivered by the paper feeding roller 124 or the like of the paper feeding unit 103 is positioned between the delivery belt 129 of the transfer unit 104 and the photosensitive drum 108 of the process cartridges 106Y, 106M, 106C and 106K, the image forming apparatus 101 transfers the toner image formed on the external surface of the photosensitive drum 108 to the recording paper 107. The image forming apparatus 101 fixes the toner image onto the recording paper 107 by the fixing unit 105. In such a way, the image forming apparatus 101 forms a color image on the recording paper 107.

As described above, the present invention includes the above described process cartridges 106Y, 106M, 106C and 106K so that the image forming apparatus 101 of a smaller size can be provided.

(Evaluation Test A)

The inventors of the present invention implemented a stiffness property test, a change of form test, an assembly property test, a drop off prevention test, a magnetic carrier attachment test and an agent severance property test using a magnet roller illustrated in the first embodiment (embodiment A1 through A4) and another magnet roller as the target of comparison (comparison example D1 through D4).

Embodiment A1

A compound of anisotropic Sr ferrite and PA12 (manufactured by Toda Kogyo Corp.) is used for the main body part 140. The main body part 140 is injection molded at a resin temperature of 300° C. while a magnetic field of 0.6 T is simultaneously applied in a direction approximately parallel to the bottom surface 1442 of the main body groove 144. Thereafter a magnetic field of 0.1 T is applied in a reverse direction to the direction during injection to demagnetize. Consequently, the main body part 140 of an external diameter ϕ of 8.5 mm and an overall length of 313 mm is obtained. In the main body groove 144 of the main body part 140, the bottom surface 1442 is shaped to have a width of 2.7 mm, a tapered angle of 5 degrees is formed, the pair of tapered surfaces 1441*b* is shaped to have a width of 2.2 mm, the pair of straight surfaces 1441*a* is shaped to have a width of 0.17 mm. The groove shape of the main body groove is realized by the shape of a placed piece disposed orthogonal to the direction of the oriented magnetic field.

SUS301-¾H, that is, a spring material of non magnetic metal with a width of 6.0 mm, a length of 313 mm and a thickness of 0.3 mm is applied bending work to obtain the interposition member 142. In the interposition member 142, the floor part 1422 is shaped to have an outermost width of 2.6 mm, the pair of wall sections 1421 is shaped to have an outermost height of 2.3 mm, a 5 degrees spread angle (that is, an angle against the direction orthogonal to the width direction of the floor part) is formed.

For the rare earth magnet block 141, 950 g of anisotropic Nd—Fe—B magnetic powders (Magfine MF-P13 manufactured by Aichi Steel Corp.) and 50 g of minute resin particles of thermal plasticity (against 100 parts by weight of polyester resin, 1.5 parts by weight of quaternary ammonium salt (charged control agent), 1.5 parts by weight of styrene acryl resin (low softening point material) and 2.0 parts by weight of carbon black are added internally, 1.5 parts by weight of silica (H2000) is added externally) are kneaded in a tumbler mixer to be filled into the metal mold thereafter. The rare earth magnet block 141 is then compression molded within the magnetic field under a pressed pressure of 400 kN while an oriented current of 100 A is applied in a 90 degrees direction against the pressed direction. Thereafter the metal mold and the magnet block are demagnetized at a pulse voltage of 3500V, demolded and burned at 100° C. for 60 minutes. Consequently, the rare earth magnet block 141 of a width of 2.0 mm, a height of 2.4 mm, a length of 313 mm and a "R" shaped upper surface (reverse to the side of press-fitting) is obtained.

The rare earth magnet block 141 is magnetized. Next, the rare earth magnet block 141 is press-fitted into the concave portion 1423 of the interposition member 142. Then the interposition member 142 is press-fitted into the main body groove 144 of the main body part 140. Thereby the magnet roller 133A of the embodiment A1 is obtained.

Embodiment A2

The embodiment A2 is the same as the embodiment A1 except that the material for the interposition member 142 is changed to a spring material of SUS301-H.

Embodiment A3

The embodiment A3 is the same as the embodiment A1 except that the rare earth magnet block 141 is first press-fitted into the interposition member 142. Then the rare earth magnet block 141 is magnetized. Thereafter the interposition member 142 is press-fitted into the main body groove 144 of the main body part 140.

Embodiment A4

The embodiment A4 is the same as the embodiment A2 except that the rare earth magnet block 141 is first press-fitted into the interposition member 142. Then the rare earth magnet block 141 is magnetized. Thereafter the interposition member 142 is press-fitted into the main body groove 144 of the main body part 140.

Comparison Example D1

A compound of anisotropic Sr ferrite and PA12 (manufactured by Toda Kogyo Corp.) is used for a magnet roller main body part having a groove shape. The magnet roller main body part is injection molded at a resin temperature of 300° C. while a magnetic field of 0.6 T is simultaneously applied in a direction parallel to a bottom surface of the groove of the magnet roller main body part. Thereafter a magnetic field of 0.1 T is applied in a reverse direction to the direction during injection to demagnetize. Consequently, the magnet roller main body part of an axial integrated type is obtained having an external diameter ϕ of 8.5 mm and an overall length of 313 mm. The groove of the magnet roller main body part is shaped so that the bottom surface has a width of 2.1 mm, a tapered angle of 5 degrees is formed, a pair of tapered surfaces has a width of 1.9 mm and a pair of straight surfaces has a width of 0.17 mm. The groove shape of the magnet roller main body part is realized by the shape of a placed piece disposed orthogonal to the direction of the oriented magnetic field.

For a rare earth magnet block, 950 g of anisotropic Nd—Fe—B magnetic powders (Magfine MF-P13 manufactured by Aichi Steel Corp.) and 50 g of minute resin particles of thermal plasticity (against 100 parts by weight of polyester resin, 1.5 parts by weight of quaternary ammonium salt (charged control agent), 1.5 parts by weight of styrene acryl resin (low softening point material) and 2.0 parts by weight of carbon black are added internally, 1.5 parts by weight of silica (H2000) is added externally) are kneaded in a tumbler mixer to be filled into the metal mold thereafter. The rare earth magnet block is then compression molded within the magnetic field under a pressed pressure of 400 kN while an oriented current of 100 A is applied in a 90 degrees direction against the pressed direction. Thereafter the metal mold and the magnet block are demagnetized at a pulse voltage of 3500V, demolded and burned at 100° C. for 60 minutes. Consequently, the rare earth magnet block of a width of 2.0 mm, a height of 2.4 mm, a length of 313 mm and an "R" shaped side reverse to the side of press-fitting is obtained.

The rare earth magnet block is magnetized. Next, the rare earth magnet block is press-fitted into the axial integrated type magnet roller main body having the groove shape. Thereby the magnet roller of the comparison example D1 is obtained.

Comparison Example D2

The comparison example D2 is the same as the embodiment A1 except that the shape of the placed piece is changed to obtain an axial integrated type magnet roller in which a main body groove 144 includes a bottom surface 1442 shaped to have a width of 2.7 mm, a tapered angle of 5 degrees, a pair of tapered surfaces 1441*b* shaped to have a width of 2.4 mm, a pair of straight surfaces 1441*a* shaped to have no width (0 mm).

Comparison Example D3

The comparison example D3 is the same as the embodiment A1 except that the material used for the interposition member 142 is changed to a spring material of SUS420J2 having magnetic property.

Comparison Example D4

The comparison example D4 is the same as the embodiment A1 except that the oriented magnetic field is applied in a direction approximately orthogonal to the bottom surface 1442 of the main body groove 144.

Each of the constitutions of the above-described embodiment A1 through A4 and comparison example D1 through D4 is illustrated in table 1.

TABLE 1

| | groove shape of the magnet roller | material of the interposition member | assembly sequence of the rare earth magnet block | relationship between the oriented magnetic field and the main body groove |
|---|---|---|---|---|
| Embodiment A1 | straight part and tapered part | SUS301-3/4H (non magnetic) | magnetize → press-fitted into the interpostition member → press-fitted into the magnet roller | approximately parallel to the bottom surface of the main body groove |

TABLE 1-continued

| | groove shape of the magnet roller | material of the interposition member | assembly sequence of the rare earth magnet block | relationship between the oriented magnetic field and the main body groove |
|---|---|---|---|---|
| Embodiment A2 | straight part and tapered part | SUS301-H (non magnetic) | magnetize → press-fitted into the interpostition member → press-fitted into the magnet roller | approximately parallel to the bottom surface of the main body groove |
| Embodiment A3 | straight part and tapered part | SUS301-3/4H (non magnetic) | press-fitted into the interposition member → magnetize → press-fitted into the magnet roller | approximately parallel to the bottom surface of the main body groove |
| Embodiment A4 | straight part and tapered part | SUS301-H (non magnetic) | press-fitted into the interposition member → magnetize → press-fitted into the magnet roller | approximately parallel to the bottom surface of the main body groove |
| Comparison ExampleD1 | straight part and tapered part | none | magnetize → press-fitted into the magnet roller | approximately parallel to the bottom surface of the main body groove |
| Comparison ExampleD2 | without straight part | SUS301-3/4H (non magnetic) | magnetize → press-fitted into the interpostition member → press-fitted into the magnet roller | approximately parallel to the bottom surface of the main body groove |
| Comparison ExampleD3 | straight part and tapered part | SUS402J2 (magnetic) | magnetize → press-fitted into the interpostition member → press-fitted into the magnet roller | approximately parallel to the bottom surface of the main body groove |
| Comparison ExampleD4 | straight part and tapered part | SUS301-3/4H (non magnetic) | magnetize → press-fitted into the interpostition member → press-fitted into the magnet roller | approximately orthogonal to the bottom surface of the main body groove |

(Test Method)

(1) Stiffness Property Test

Figure 21:
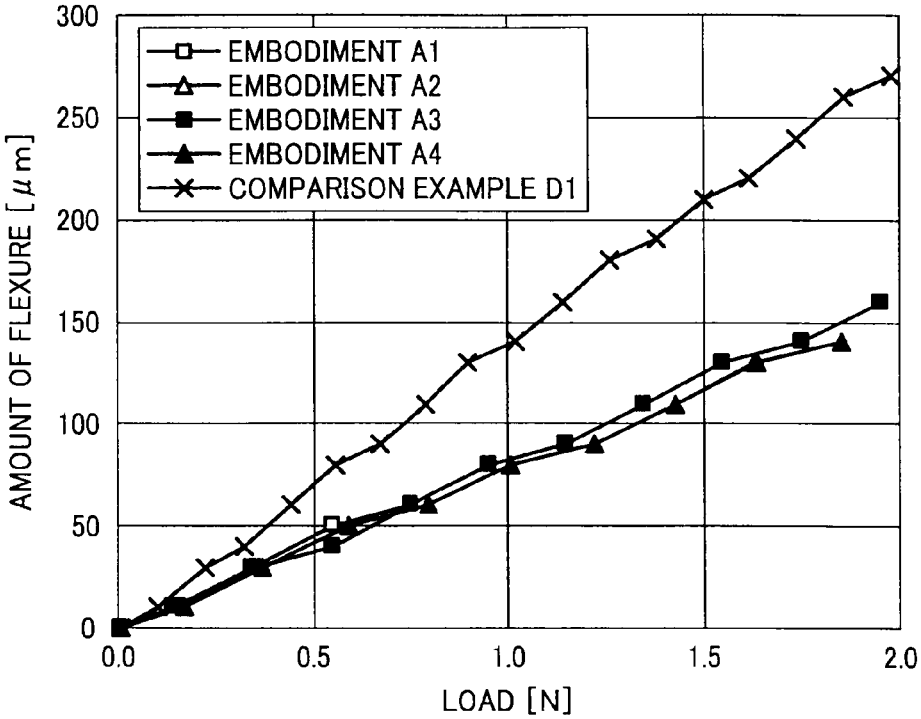
FIG. 21 is a graph that illustrates a relationship between the amount of displacement (flexure amount) and load against the magnet roller.

The magnet rollers of the embodiment A1 through A4 and the comparison example D1 are supported with a 300 mm distance between supporting points. When a load up to 3N is applied to the central part of the magnet rollers, amount of displacement (amount of flexure) is read by a lever type dial gauge. The slope of the load and the amount of flexure (in the unit of μm/N) is set as stiffness. The smaller is the slope, the higher is the stiffness (flexure is difficult to be generated). A graph summarizing the test result is illustrated in FIG. 21.

(2) Change of Form Test

Figure 22:
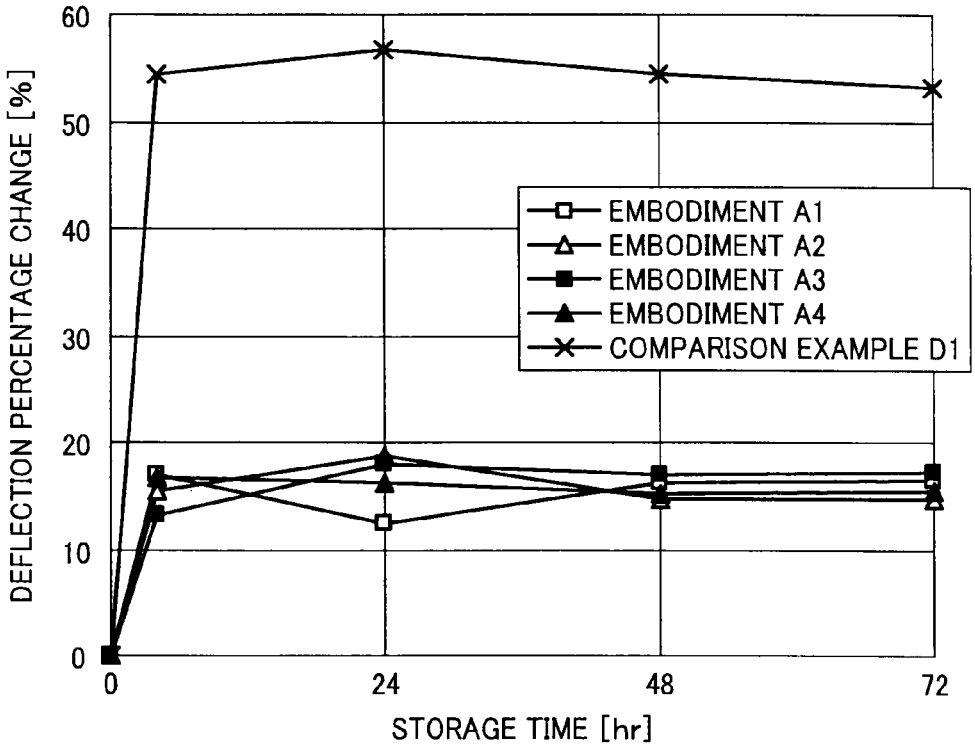
FIG. 22 is a graph that illustrates a relationship between the deflection variation ratio and storage time of the magnet roller.

The magnet rollers of the embodiment A1 through A4 and the comparison example D1 are disposed and stored for 72 hours in an environment of a temperature of 60° C. and a humidity of 80% RH. A laser end-measuring machine measures a deflection percentage change at the center of the body of the magnet rollers. The deflection percentage change is analyzed and a graph summarizing the test result is illustrated in FIG. 22.

(3) Assembly Property Test

When 1000 pieces of each of the magnet rollers of the embodiment A1 through A4 and the comparison example D1 are manufactured, the number of damaged rare earth magnet blocks when the rare earth magnet blocks are press-fitted is recorded.

(4) Drop Off Prevention Test 1000 pieces of each of the magnet rollers of the embodiment A1 through A4 and the comparison example D2 are manufactured. An image development sleeve of an external diameter of 10 mm, an internal diameter of 9.3 mm and a length of 325 mm is fixed on each of the magnet rollers so that image development rollers of an external diameter of 10 mm are obtained. Then a unit testing machine is mounted on each of the image development rollers. The image development rollers are then operated for 150 hours with the angular speed (rotation frequency) of the image development sleeves set to 400 RPM. Thereafter the number of interposition members dropped off (including positional displacements) is recorded.

(5) Magnetic Carrier Attachment Test

The magnet rollers of the embodiment A1 through A4 and the comparison example D3 are roller magnetized to obtain a final magnetic waveform. AL sleeves applied with SWB processing (external diameter ϕ 10 mm/internal diameter ϕ 9 mm) are fixed onto the magnet rollers so that image development rollers are obtained. An image development device is fixed on each of the image development rollers and a running test is performed. The number of carriers that passed over onto the photosensitive drum during the test is measured.

(6) Agent Severance Property Test

The magnet rollers of the embodiment A1 through A4 and the comparison example D4 are roller magnetized to obtain a final magnetic waveform. Image development sleeves made of aluminum and applied with SWB processing (external diameter ϕ 10 mm/internal diameter ϕ 9 mm) are fixed onto the magnet rollers so that image development rollers are obtained. The image development sleeve of the image development roller is rotated and the agent severance property of the developer agent is evaluated.

Each evaluation result is described by the following signs and summarized in Table 2.

◎: excellent

X: outside acceptable range (not suited for practical use)

※1: with no interposition member

※2: the same as the embodiment A1 of the interposition member is caught by the pair of straight surfaces. Consequently, it is clear that drop off of the interposition member from the main body groove can be prevented. On the other hand, in the comparison example D2, a pair of straight surfaces is not disposed so that it is clear that the interposition member easily drops off. Therefore, it is clear that by disposing the pair of straight surfaces in the pair of side surfaces of the main body groove, drop off of the interposition member can be prevented.

In addition, from the results of embodiment A1 through A4 and the comparison example D3, in the embodiment A1 through A4, it is clear that fly over of magnetic carriers onto the photosensitive drum can be suppressed and the magnetic

TABLE 2

| | (1) Stiffness property test stiffness [μm/N] | (2) Change of form test deflection percentage change [%] | (3) Assembly property test number of damaged rare earth magnet | (4) Drop off prevention test number of dropped off interposition member | (5) Magnetic carrier attachment test number of attached magnetic carriers | (6) Agent severance property test agent severance property |
|---|---|---|---|---|---|---|
| Embodiment A1 | ◎: 81.2 | ◎: below 17 | ◎: 0/1000 piece | ◎: 0/1000 piece | ◎: below 10 | ◎: with no ceaseless adhering of the developer agent |
| Embodiment A2 | ◎: 77.9 | ◎: below 19 | ◎: 0/1000 piece | ◎: 0/1000 piece | ◎: below 10 | ◎: with no ceaseless adhering of the developer agent |
| Embodiment A3 | ◎: 81.7 | ◎: below 18 | ◎: 0/1000 piece | ◎: 0/1000 piece | ◎: below 10 | ◎: with no ceaseless adhering of the developer agent |
| Embodiment A4 | ◎: 78.0 | ◎: below 17 | ◎: 0/1000 piece | ◎: 0/1000 piece | ◎: below 10 | ◎: with no ceaseless adhering of the developer agent |
| Comparison Example D1 | X: 139.2 | X: above 50 | X: 30/1000 pieces | ※1 | ※2 | ※2 |
| Comparison Example D2 | ※2 | ※2 | ※2 | X: 20/1000 pieces | ※2 | ※2 |
| Comparison Example D3 | ※2 | ※2 | ※2 | ※2 | X: above 50 | ※2 |
| Comparison Example D4 | ※2 | ※2 | ※2 | ※2 | ※2 | X: ceaseless adhering of the developer agent is present |

◎: excellent

X: outside acceptable range (not suited for practical use)

※1: with no interposition member

※2 the same to the embodiment A1

Results of the evaluation test A are discussed hereinbelow.

From the results of embodiment A1 through A4 and the comparison example D1, in the embodiment A1 through A4 constituted to include the interposition member, high stiffness of the magnet roller is realized. As a result, deflection percentage change is suppressed to be less or equal to 20%. On the other hand, in the comparison example D1, the magnet roller has insufficient stiffness and deflection percentage change exceeds 50%. Therefore, it is clear that by including the interposition member, stiffness of the magnet roller can be heightened. In addition, in the embodiment A1 through A4, first, the rare earth magnet block is press-fitted into the interposition member 142. Then the interposition member 142 press-fitted with the rare earth magnet block is press-fitted into the main body groove 144. Consequently, damages generated to the rare earth magnet block during assembly can be avoided. On the other hand, in the comparison example D1, damages are generated to the rare earth magnet block. Therefore, it is clear that the rare earth magnet block can be reinforced by the interposition member and assembly property (productivity) of the magnet roller can be improved.

In addition, from the results of embodiment A1 through A4 and the comparison example D2, in the embodiment A1 through A4, the pair of straight surfaces is disposed in the pair of side surfaces of the main body groove so that the upper end carriers can be attracted to the external surface of the image development roller by the strong magnetic force generated. On the other hand, in the comparison example D3, fly over of magnetic carriers onto the photosensitive drum is generated. Consequently, it is clear that magnetic force generated on the external surface of the image development roller is weakened. Therefore, it is clear that by using non magnetic materials for the interposition member, strong magnetic force can be generated.

In addition, from the results of embodiment A1 through A4 and the comparison example D4, in the embodiment A1 through A4, it is clear that ceaseless adhering of the developer agent to the image development roller is not present. On the other hand, in the comparison example D4, it is clear that ceaseless adhering of the developer agent is generated. Consequently, it is clear that magnetic force of the pole shift point can be weakened when the oriented direction of magnetic anisotropy of the magnet roller (main body part) is set to be approximately parallel to the bottom surface of the main body groove and approximately orthogonal to the axial direction and the developer agent can be severed at this position.

In addition, from the results of embodiment A1 through A4, it is clear that no great difference is generated to the test result even if the materials used for the interposition member differ when the interposition member is shaped using non magnetic materials. In addition, it is also clear that the sequence of the magnetization of the rare earth magnet block does not have any influence on the test result.

(Evaluation Test B)

The inventors of the present invention implemented an evaluation test with regard to positional displacements or drop off of an interposition member generated when the interposition member is press-fitted into the main body groove and the state of contact between an operated magnet roller and an image development sleeve using a magnet roller illustrated in the second embodiment (embodiment B1 through B5) and another magnet roller as the target of comparison (comparison example E1).

Embodiment B1

A compound of anisotropic Sr ferrite and PA12 (manufactured by Toda Kogyo Corp.) is used for the main body part 240. The main body part 240 is injection molded at a resin temperature of 300° C. while a magnetic field of 0.6 T is simultaneously applied in a direction approximately parallel to the bottom surface 2442 of the main body groove 244. Thereafter a magnetic field of 0.1 T is applied in a reverse direction to the direction during injection to demagnetize. Consequently, the main body part 240 is obtained. The main body part 240 is shaped to have an external diameter ϕ of 8.5 mm and an overall length of 313 mm. In the main body groove 244 of the main body part 240, the bottom surface 2442 is shaped to have a width of 2.7 mm, a pair of side surfaces 2421 is shaped to have a height (width) of 2.4 mm and a 0 degree tapered angle is formed.

An interposition member 242 is a "U" character shaped member of a thickness of 0.3 mm and a length of 313 mm in which the width of a floor part 2422 is shaped to 2.6 mm, the height of a pair of wall sections 2421 is shaped to 2.3 mm. In the interposition member 242, external surface wedge 2421*g* of a length of 0.1 mm is disposed in an interval of 0.6 mm. Similarly, internal surface wedge 2421*h* of a length of 0.1 mm is disposed in an interval of 0.6 mm. Wedge grooves 2421*e* of the external surface are misaligned for 0.3 mm in position against wedge grooves 2421*f* of the internal surface. The wedge groove 2421*e* of the external surface is disposed at 4 positions of an external surface 2421*c*. Similarly, the wedge groove 2421*f* of the internal surface is disposed at 4 positions of an internal surface 2421*d*.

After each wedge groove is disposed in such a way, the pair of wall sections 2421 of the interposition member 242 is subjected to bending work so that the pair of wall sections forms a 90 degrees angle (that is, a 0 degree spread angle) against the floor part 2422 so that the interposition member 242 with a saw blade shaped pair of wall sections is obtained.

For the rare earth magnet block 141, 950 g of anisotropic Nd—Fe—B magnetic powders (Magfine MF-P13 manufactured by Aichi Steel Corp.) and 50 g of minute resin particles of thermal plasticity (against 100 parts by weight of polyester resin, 1.5 parts by weight of quaternary ammonium salt (charged control agent), 1.5 parts by weight of styrene acryl resin (low softening point material) and 2.0 parts by weight of carbon black are added internally, 1.5 parts by weight of silica (H2000) is added externally) are kneaded in a tumbler mixer to be filled into the metal mold thereafter. The rare earth magnet block 141 is then compression molded within the magnetic field under a pressed pressure of 400 kN while an oriented current of 100 A is applied in a 90 degrees direction against the pressed direction. Thereafter the metal mold and the magnet block are demagnetized at a pulse voltage of 3500V, demolded and burned at 100° C. for 60 minutes. Consequently, the rare earth magnet block 141 of a width of 2.0 mm, a height of 2.4 mm, a length of 313 mm and an "R" shaped side reverse to the side of press-fitting is obtained.

The rare earth magnet block 141 is magnetized and then press-fitted into the interposition member 242. Next, the interposition member is press-fitted into the main body groove 244 of the main body part 240. Thereby the magnet roller 133B of the embodiment B1 is obtained.

Embodiment B2

The embodiment B2 is the same as the embodiment B1 except the magnet roller 133B is obtained by applying bending work to the interposition member 242 so that the pair of wall sections 2421 of the interposition member 242 forms a 95 degrees angle (that is, a 5 degree spread angle) against the floor part 2422.

Embodiment B3

The embodiment B3 is the same as the embodiment B1 except the main body part 240 is shaped to have an external diameter ϕ of 8.5 mm and an overall length of 313 mm. In the main body groove 244 of the main body part 240, the bottom surface 2442 is shaped to have a width of 2.7 mm, a pair of side surfaces 2421 is shaped to have a height (width) of 2.4 mm and a 5 degrees tapered angle is formed. The interposition member 242 is applied bending work so that the pair of wall sections 2421 of the interposition member 242 forms a 95 degrees angle (that is, a 5 degree spread angle) against the floor part 2422.

Embodiment B4

The embodiment B4 is the same as the embodiment B1 except that in the interposition member 242, external surface wedge 2421*g* of a length of 0.1 mm is disposed in an interval of 0.8 mm. Similarly, internal surface wedge 2421*h* of a length of 0.1 mm is disposed in an interval of 0.8 mm. Wedge grooves 2421*e* of the external surface are misaligned for 0.4 mm in position against wedge grooves 2421*f* of the internal surface. The wedge groove 2421*e* of the external surface is disposed at 3 positions of an external surface 2421*c*. Similarly, the wedge groove 2421*f* of the internal surface is disposed at 3 positions of an internal surface 2421*d*. The magnet roller 133B is obtained under such a constitution.

Embodiment B5

The embodiment B5 is the same as the embodiment B1 except that in the interposition member 242, external surface wedge 2421*g* of a length of 0.07 mm is disposed in an interval of 0.6 mm. Similarly, the internal surface wedge 2421*h* of a length of 0.07 mm is disposed in an interval of 0.6 mm. Wedge grooves 2421*e* of the external surface are misaligned for 0.3 mm in position against wedge grooves 2421*f* of the internal surface. The wedge groove 2421*e* of the external surface is disposed at 4 positions of an external surface 2421*c*. Similarly, the wedge groove 2421*f* of the internal surface is disposed at 4 positions of an internal surface 2421*d*. The magnet roller 133B is obtained under such a constitution.

Comparison Example E1

A compound of anisotropic Sr ferrite and PA12 (manufactured by Toda Kogyo Corp.) is used for a magnet roller main body part having a groove shape. The magnet roller main body part is injection molded at a resin temperature of 300° C. while a magnetic field of 0.6 T is simultaneously applied in a direction parallel to a bottom surface of the groove of the magnet roller main body part. Thereafter a magnetic field of 0.1 T is applied in a reverse direction to the direction during injection to demagnetize. Consequently, the magnet roller main body part of an axial integrated type is obtained having an external diameter ϕ of 8.5 mm and an overall length of 313 mm. The groove of the magnet roller main body part is shaped so that the bottom surface has a width of 2.7 mm, a pair of side surfaces has a height (width) of 2.4 mm and a tapered angle of 0 degrees is formed.

An interposition member in the comparison example E1 is a "U" character shaped member of a thickness of 0.3 mm and a length of 313 mm in which the width of a floor part is shaped to 2.6 mm, the height (width) of a pair of wall sections is shaped to 2.3 mm. The interposition member includes no saw blade shaped parts. In addition, the angle formed by the pair of wall sections of the interposition member against the floor part is 90 degrees.

For a rare earth magnet block, 950 g of anisotropic Nd—Fe—B magnetic powders (Magfine MF-P13 manufactured by Aichi Steel Corp.) and 50 g of minute resin particles of thermal plasticity (against 100 parts by weight of polyester resin, 1.5 parts by weight of quaternary ammonium salt (charged control agent), 1.5 parts by weight of styrene acryl resin (low softening point material) and 2.0 parts by weight of carbon black are added internally, 1.5 parts by weight of silica (H2000) is added externally) are kneaded in a tumbler mixer to be filled into the metal mold thereafter. The rare earth magnet block is then compression molded within the magnetic field under a pressed pressure of 400 kN while an oriented current of 100 A is applied in a 90 degrees direction against the pressed direction. Thereafter the metal mold and the magnet block are demagnetized at a pulse voltage of 3500V, demolded and burned at 100° C. for 60 minutes. Consequently, the rare earth magnet block of a width of 2.0 mm, a height of 2.4 mm, a length of 313 mm and an "R" shaped side reverse to the side of press-fitting is obtained.

The rare earth magnet block is first magnetized and then press-fitted into the interposition member. Next, the interposition member together with the rare earth magnet block is press-fitted into the groove shaped axial integrated type magnet roller so that the magnet roller of the comparison example E1 is obtained.

(Test Method)

(7) Drop Off Prevention Test 1000 pieces of each of the magnet rollers of the embodiment B1 through B5 and the comparison example E2 are manufactured. An image development sleeve of an external diameter of 10 mm, an internal diameter of 9.3 mm and a length of 325 mm is fixed on each of the magnet rollers so that image development rollers of an external diameter of 10 mm are obtained. Then a unit testing machine is mounted on each of the image development rollers. The image development rollers are then operated for 150 hours with the angular speed (rotation frequency) of the image development sleeves set to 400 RPM. Thereafter the number of interposition members dropped off (including positional displacements) is recorded. Besides, rotational states of the image development sleeves during operation are also confirmed.

Evaluation results of each of the above described embodiments B1 through B5 and the comparison example E1 are described by the following signs and summarized in table 3.

◎: excellent

X: outside acceptable range (not suited for practical use)

○: the image development sleeve and the rare earth magnet block are not in contact and the image development sleeve maintains a constant angular velocity.

X: the image development sleeve and the rare earth magnet block are in contact and the image development sleeve is locked.

TABLE 3

| | (7) Drop off prevention test | |
|---|---|---|
| | positional displacements and drop offs after press-fitting | state of contact with the image development sleeve during operation |
| Embodiment B1 | ◎: 0/1000 piece | ○ |
| Embodiment B2 | ◎: 0/1000 piece | ○ |
| Embodiment B3 | ◎: 0/1000 piece | ○ |
| Embodiment B4 | ◎: 0/1000 piece | ○ |
| Embodiment B5 | ◎: 0/1000 piece | ○ |
| Comparison Example E1 | X: 20/1000 piece | X |

◎: excellent

X: outside acceptable range (not suited for practical use)

○: the image development sleeve and the rare earth magnet block are not in contact and the image development sleeve maintains a constant angular velocity.

X: the image development sleeve and the rare earth magnet block are in contact and the image development sleeve is locked.

Results of the evaluation test B are discussed hereinbelow.

From the results of the embodiment B1 through B5 and the comparison example E1, in the embodiment B1 through B5, there are no positional displacements and drop offs of the interposition member during operation. On the other hand, in the comparison example E1, it is clear that the interposition member easily drops off. Therefore, it is clear that by disposing wedge grooves of the external surface and wedge grooves of the internal surface in the interposition member, positional displacements and drop offs of the interposition member can be prevented.

In addition, from the results of the embodiment B1 through B5, it is clear that positional displacements and drop offs of the interposition member can be prevented if at least the tapered angle of the main body groove 244 is 0 to 5 degrees and the spread angle of the pair of wall sections 2421 in the interposition member 242 is greater or equal to the tapered angle. In addition, it is clear that positional displacements and drop offs of the interposition member can be prevented if at least the length of the external surface wedges 2421*g* and the internal surface wedges 2421*h* is in the range of 0.07 to 0.1 mm, the interval of the external surface wedges 2421*g* and the interval of the internal surface wedges 2421*h* is in the range of 0.6 to 0.8 mm and the positional misalignment between the wedge grooves 2421*e* of the external surface and the wedge grooves 2421*f* of the internal surface is in the range of 0.3 to 0.4 mm.

(Evaluation Test C)

The inventors of the present invention implemented a stiffness property test, a change of form test, a drop off prevention test and an agent severance property test using a magnet roller illustrated in the third embodiment (embodiment C1 through C4) and another magnet roller as the target of comparison (comparison example F1 through F3).

Embodiment C1

A compound of anisotropic Sr ferrite and PA12 (manufactured by Toda Kogyo Corp.) is used for the main body part 340. The main body part 340 is injection molded at a resin temperature of 300° C. while a magnetic field of 0.6 T is simultaneously applied in a direction approximately parallel to the bottom surface 3442 of the main body groove 344. Thereafter a magnetic field of 0.1 T is applied in a reverse direction to the direction during injection to demagnetize. Consequently, the main body part 340 of an external diameter ϕ of 8.5 mm and an overall length of 313 mm is obtained. In the main body groove 344 of the main body part 340, the bottom surface 3442 is shaped to have a width of 2.7 mm, a distance from the axial center to the bottom surface 3442 is shaped to 1.85 mm, the width of an opening part of the main body groove 344 is shaped to 2.31 mm, the angle formed by the bottom surface 3442 and a pair of side surfaces 3441 is shaped to 85 degrees (that is, reverse tapered shaped). The groove shape of the main body groove is realized by the shape of a placed piece disposed orthogonal to the direction of the oriented magnetic field.

SUS301-¾H, that is, a spring material of non magnetic metal with a thickness of 0.3 mm is applied bending work to obtain the interposition member 342. In the interposition member 342, the length (width) of the side of the upper surface 3422*a* of the floor part 3422 is shaped to 1.6 mm, the length (height) of the side of the internal surface 3421*d* of the pair of wall sections 3421 is shaped to 1.92 mm, the floor part 3422 is concave "R" shaped (refer to FIG. 10) and a 3 degrees spread angle is formed.

For the rare earth magnet block 141, 950 g of anisotropic Nd—Fe—B magnetic powders (Magfine MF-P13 manufactured by Aichi Steel Corp.) and 50 g of minute resin particles of thermal plasticity (against 100 parts by weight of polyester resin, 1.5 parts by weight of quaternary ammonium salt (charged control agent), 1.5 parts by weight of styrene acryl resin (low softening point material) and 2.0 parts by weight of carbon black are added internally, 1.5 parts by weight of silica (H2000) is added externally) are kneaded in a tumbler mixer to be filled into the metal mold thereafter. The rare earth magnet block 141 is then compression molded within the magnetic field under a pressed pressure of 400 kN while an oriented current of 100 A is applied in a 90 degrees direction against the pressed direction. Thereafter the metal mold and the magnet block are demagnetized at a pulse voltage of 3500V, demolded and burned at 100° C. for 60 minutes. Consequently, the rare earth magnet block 141 of a width of 1.76 mm, a height of 2.4 mm, a length of 313 mm and an "R" shaped side reverse to the side of press-fitting is obtained.

The rare earth magnet block 141 is first magnetized. Next, the rare earth magnet block 141 and the interposition member 342 are simultaneously press-fitted into the main body groove 344 of the main body part 340 so that the magnet roller 133C of the embodiment C1 is obtained.

Embodiment C2

The embodiment C2 is the same as the embodiment C1 except that in the interposition member 342, the length (width) of the side of the upper surface 3422*a* of the floor part 3422 is shaped to 1.6 mm, the length (height) of the side of the internal surface 3421*d* of the pair of wall sections 3421 is shaped to 1.92 mm, the floor part 3422 is convex "R" shaped (refer to FIG. 11) and a 3 degrees spread angle is formed.

Embodiment C3

The embodiment C3 is the same as the embodiment C1 except that in the interposition member 342, the length (width) of the side of the upper surface 3422*a* of the floor part 3422 is shaped to 1.6 mm, the length (height) of the side of the internal surface 3421*d* of the pair of wall sections 3421 is shaped to 1.92 mm, the floor part 3422 is "V" letter shaped (refer to FIG. 12) and a 3 degrees spread angle is formed.

Embodiment C4

The embodiment C4 is the same as the embodiment C1 except that in the interposition member 342, the length (width) of the side of the upper surface 3422*a* of the floor part 3422 is shaped to 1.6 mm, the length (height) of the side of the internal surface 3421*d* of the pair of wall sections 3421 is shaped to 1.92 mm, the floor part 3422 is reverse "V" letter shaped (refer to FIG. 13) and a 3 degrees spread angle is formed.

Comparison Example F1

A compound of anisotropic Sr ferrite and PA12 (manufactured by Toda Kogyo Corp.) is used for a magnet roller main body part having a groove shape. The magnet roller main body part is injection molded at a resin temperature of 300° C. while a magnetic field of 0.6 T is simultaneously applied in a direction parallel to a bottom surface of the groove of the magnet roller main body part. Thereafter a magnetic field of 0.1 T is applied in a reverse direction to the direction during injection to demagnetize. Consequently, the magnet roller main body part of an axial integrated type is obtained having an external diameter ϕ of 8.5 mm and an overall length of 313 mm. The groove of the magnet roller main body part is shaped so that the bottom surface has a width of 2.1 mm, a pair of side surfaces has a height (width) of 2.4 mm and a tapered angle of 5 degrees is formed. The groove shape of the magnet roller main body part is realized by the shape of a placed piece disposed orthogonal to the direction of the oriented magnetic field.

For a rare earth magnet block, 950 g of anisotropic Nd—Fe—B magnetic powders (Magfine MF-P13 manufactured by Aichi Steel Corp.) and 50 g of minute resin particles of thermal plasticity (against 100 parts by weight of polyester resin, 1.5 parts by weight of quaternary ammonium salt (charged control agent), 1.5 parts by weight of styrene acryl resin (low softening point material) and 2.0 parts by weight of carbon black are added internally, 1.5 parts by weight of silica (H2000) is added externally) are kneaded in a tumbler mixer to be filled into the metal mold thereafter. The rare earth magnet block is then compression molded within the magnetic field under a pressed pressure of 400 kN while an oriented current of 100 A is applied in a 90 degrees direction against the pressed direction. Thereafter the metal mold and the magnet block are demagnetized at a pulse voltage of 3500V, demolded and burned at 100° C. for 60 minutes. Consequently, the rare earth magnet block of a width of 2.0 mm, a height of 2.4 mm, a length of 313 mm and an "R" shaped side reverse to the side of press-fitting is obtained.

The rare earth magnet block is first magnetized. Then the rare earth magnet block is press-fitted into the groove shaped axial integrated type magnet roller so that the magnet roller of the comparison example F1 is obtained.

Comparison Example F2

The comparison example F2 is the same as the embodiment C1 except the main body groove 344 of an axial integrated type magnet roller main body part is shaped so that the width of the bottom surface 3442 is 2.7 mm, the distance from the axial center to the bottom surface 3442 is 1.85 mm, the width of the opening part of the main body groove 344 is 2.31 mm and a tapered angle of 5 degrees is formed. Besides, an interposition member 342 is obtained in which the length (width) of the side of the upper surface 3422*a* of the floor part 3422 is shaped to 2.15 mm, the length (height) of the side of the internal surface 3421*d* of the pair of wall sections 3421 is shaped to 1.85 mm and the pair of wall sections 3421 forms a 5 degrees spread angle.

Comparison Example F3

The comparison example F3 is the same as the embodiment C1 except the applied direction of the oriented magnetic field is approximately orthogonal to the bottom surface 3442 of the main body groove 344.

Each of the constitutions of the above-described embodiment C1 through C4 and the comparison example F1 through F3 is illustrated in table 4.

TABLE 4

| | groove shape of the magnet roller | material of the interposition member | shape of the bottom surface of the interposition member | relationship between the oriented magnetic field and the groove |
|---|---|---|---|---|
| Embodiment C1 | a reverse tapered angle of 85 degrees is formed between the bottom surface of the main body groove and the pair of side surfaces | SUS301-3/4H (non magnetic) | concave "R" shaped | approximately parallel to the bottom surface of the main body groove |
| Embodiment C2 | a reverse tapered angle of 85 degrees is formed between the bottom surface of the main body groove and the pair of side surfaces | SUS301-3/4H (non magnetic) | convex "R" shaped | approximately parallel to the bottom surface of the main body groove |
| Embodiment C3 | a reverse tapered angle of 85 degrees is formed between the bottom surface of the main body groove and the pair of side surfaces | SUS301-3/4H (non magnetic) | "V" letter shaped | approximately parallel to the bottom surface of the main body groove |
| Embodiment C4 | a reverse tapered angle of 85 degrees is formed between the bottom surface of the main body groove and the pair of side surfaces | SUS301-3/4H (non magnetic) | reverse "V" letter shaped | approximately parallel to the bottom surface of the main body groove |
| Comparison ExampleF1 | a tapered angle of 95 degrees is formed between the bottom surface of the main body groove and the pair of side surfaces | none | none | approximately parallel to the bottom surface of the main body groove |
| Comparison ExampleF2 | a tapered angle of 95 degrees is formed between the bottom surface of the main body groove and the pair of side surfaces | SUS301-3/4H (non magnetic) | flat plane shaped | approximately parallel to the bottom surface of the main body groove |
| Comparison ExampleF3 | a reverse tapered angle of 85 degrees is formed between the bottom surface of the main body groove and the pair of side surfaces | SUS301-3/4H (non magnetic) | concave "R" shaped | approximately orthogonal to the bottom surface of the main body groove |

(Test Method)

(8) Stiffness Property Test

The magnet rollers of the embodiment C1 through C4 and the comparison example F1 are supported with a 300 mm distance between supporting points. When a load up to 3N is applied to the central part of the magnet rollers, amount of displacement (amount of flexure) is read by a lever type dial gauge. The slope of the load and the amount of flexure (in the unit of μm/N) is set as stiffness. The smaller is the slope, the higher is the stiffness (flexure is difficult to be generated).

(9) Change of Form Test

The magnet rollers of the embodiment C1 through C4 and the comparison example F1 are disposed and stored for 72 hours in an environment of a temperature of 60° C. and a humidity of 80% RH. A laser end-measuring machine measures a deflection percentage change at the center of the body of the magnet rollers. The deflection percentage change is analyzed.

(10) Drop Off Prevention Test 1000 pieces of each of the magnet rollers of the embodiment C1 through C4 and the comparison example F2 are manufactured. An image development sleeve of an external diameter of 10 mm, an internal diameter of 9.3 mm and a length of 325 mm is fixed on each of the magnet rollers so that image development rollers of an external diameter of 10 mm are obtained. Then a unit testing machine is mounted on each of the image development rollers. The image development rollers are then operated for 150 hours with the angular speed (rotation frequency) of the image development sleeves set to 400 RPM. Thereafter the number of interposition members dropped off (including positional displacements) is recorded.

(11) Agent Severance Property Test

The magnet rollers of the embodiment C1 through C4 and the comparison example F3 are roller magnetized to obtain a final magnetic waveform. AL sleeves applied with SWB processing (external diameter ϕ 10 mm/internal diameter ϕ 9 mm) are fixed onto the magnet rollers so that image development rollers are obtained. The image development sleeve of the image development roller is rotated and the agent severance property of the developer agent is evaluated.

Each evaluation result is described by the following signs and summarized in table 5.

◎: excellent

X: outside acceptable range (not suited for practical use)

※1: with no interposition member

※2: the same to the embodiment C1

TABLE 5

| | (1) Stiffness property test stiffness [μm/N] | (2) Change of form test deflection percentage change [%] | (4) Drop off prevention test number of dropped off interposition member | (6) Agent severance property test agent severance property |
|---|---|---|---|---|
| Embodiment C1 | ◎: 81.2 | ◎: below 17 | ◎: 0/1000 piece | ◎: with no ceaseless adhering of the developer agent |
| Embodiment C2 | ◎: 77.9 | ◎: below 19 | ◎: 0/1000 piece | ◎: with no ceaseless adhering of the developer agent |
| Embodiment C3 | ◎: 81.7 | ◎: below 18 | ◎: 0/1000 piece | ◎: with no ceaseless adhering of the developer agent |
| Embodiment C4 | ◎: 78.0 | ◎: below 17 | ◎: 0/1000 piece | ◎: with no ceaseless adhering of the developer agent |
| Comparison Example F1 | X: 139.2 | X: above 50 | ※1 | ※2 |
| Comparison Example F2 | ※2 | ※2 | X: 20/1000 pieces | ※2 |
| Comparison Example F3 | ※2 | ※2 | ※2 | X: ceaseless adhering of the developer agent is present |

◎: excellent

X: outside acceptable range (not suited for practical use)

※1: with no interposition member

※2: the same to the embodiment C1

Results of the evaluation test C are discussed hereinbelow.

From the results of the embodiment C1 through C4 and the comparison example F1, in the embodiment C1 through C4 constituted to include the interposition member, high stiffness of the magnet roller is realized. As a result, deflection percentage change is suppressed to be less or equal to 20%. On the other hand, in the comparison example F1, the magnet roller has insufficient stiffness and deflection percentage change exceeds 50%. Therefore, it is clear that by including the interposition member, stiffness of the magnet roller can be heightened.

In addition, from the results of the embodiment C1 through C4 and the comparison example F2, in the embodiment C1 through C4, because the main body groove is reverse tapered shaped (dovetail joint shaped) and the width of the floor part of the interposition member after press-fitting is larger than the width of the opening part of the main body groove, the interposition member is caught by the pair of side surfaces of the main body groove so that it is clear drop off of the interposition member can be prevented. On the other hand, in the comparison example F2, because the main body groove is tapered shaped, it is clear that the interposition member easily drops off. Therefore, it is clear that drop off of the interposition member can be prevented if the main body groove is reverse tapered shaped and the width of the floor part of the interposition member after press-fitting is larger than the width of the opening part of the main body groove.

In addition, from the results of the embodiment C1 through C4 and the comparison example F3, in the embodiment C1 through C4, it is clear that ceaseless adhering of the developer agent to the image development roller is not present. On the other hand, in the comparison example F3, it is clear that ceaseless adhering of the developer agent is generated. Consequently, it is clear that magnetic force of the pole shift point can be weakened when the oriented direction of magnetic anisotropy of the magnet roller (main body part) is set to be approximately parallel to the bottom surface of the main body groove and approximately orthogonal to the axial direction and the developer agent can be severed at this position.

In addition, from the results of the embodiment C1 through C4, the shape of the floor part of the interposition member 342 can be concave "R" shaped, convex "R" shaped, "V" letter shaped and reverse "V" letter shaped. It is clear that drop off prevention effects of the interposition member do not change regardless of which shape.

Therefore, according to the present invention, an interposition member with a "U" character shaped cross-sectional surface is fixed in a groove of a cylindrical column-like shaped main body part. A long magnetic compact is fixed in a concave portion of the interposition member. The cylindrical column-like shaped main body part is reinforced by the interposition member so that stiffness property of the main body part can be heightened. Consequently, even in the case the cylindrical column-like shaped main body part is changed into a small diameter (that is, smaller size), stiffness property thereof can be secured. Therefore, a magnetic field generating member of high stiffness and a smaller size can be provided.

In addition, according to the present invention, the interposition member is press-fitted into the groove of the cylindrical column-like shaped main body part to be fixed thereof. Consequently, an adhesive agent is not used for fixture of these members. Hence the interposition member can be detached easily from the groove of the main body part. Therefore, reuse of the interposition member becomes possible and the magnet field generating member can be provided cheaply. In addition, because an adhesive agent is not used for the fixture of the interposition member and the groove of the main body part, positional displacements of these members generated due to the drying of the adhesive agent can be avoided. Therefore, high precision assembly is possible.

In addition, according to the present invention, the long magnetic compact is press-fitted into the concave portion of the interposition member to be fixed thereof. Consequently, an adhesive agent is not used for fixture of these members. Hence the long magnetic compact can be detached easily from the interposition member. Therefore, reuse of the long magnetic compact becomes possible and the magnet field generating member can be provided cheaply. In addition, because an adhesive agent is not used for the fixture of the interposition member and the long magnetic compact, positional displacements of these members generated due to the drying of the adhesive agent can be avoided. Therefore, high precision assembly is possible.

In addition, according to the present invention, the pair of side surfaces of the main body groove includes the pair of straight surfaces shaped mutually parallel in the vicinity of the opening part of the main body groove and the pair of tapered surfaces shaped so that mutual intervals between the pair of tapered surfaces gradually narrow from lower ends of the straight surfaces towards the bottom surface of the main body groove the closer to the bottom surface. Therefore, when the interposition member is press-fitted into the main body groove, the pair of straight surfaces serves as stoppers and drop off of the interposition member from the main body groove can be prevented. An image development device or the like breaks down due to the drop off of the interposition member. Consequently, the magnetic field generating member with high reliability that can prevent such breakdowns is provided.

In addition, according to the present invention, the external surface of the pair of wall sections in the interposition member respectively come into close contact with the pair of tapered surfaces in the main body groove. The upper end of the pair of wall sections is respectively shaped to be positioned in the boundary between the straight surface and the tapered surface. Therefore, when the interposition member is press-fitted into the main body groove, the upper end of the pair of wall sections is caught in the boundary so that the two members are mutually fixed more reliably. Consequently, drop off of the interposition member from the main body groove can be prevented more reliably. The image development device or the like breaks down due to the drop off of the interposition member. Hence the magnetic field generating member with high reliability that can prevent such breakdowns is provided.

In addition, according to the present invention, the interposition member includes, in the external surface of the pair of wall sections, wedge grooves of the external surface directed from the upper end towards the lower end and shaped to form an acute angle thereof. Besides, external surfaces of the pair of wall sections are respectively shaped to closely contact the pair of side surfaces of the main body groove. By disposing the wedge grooves of the external surface, the external surface wedges directed from the lower end towards the upper end of the pair of wall sections are shaped. Consequently, when the interposition member is press-fitted into the main body groove, without the external surface wedges, the interposition member is likely to drop off from the main body groove in a direction. However, with the external surface wedges, the external surface wedges are caught by the pair of side surfaces of the main body groove against the drop off direction so that each of these members are fixed more certainly. Therefore, drop off of the interposition member from the main body groove and positional displacements thereof can be prevented more reliably. The image development device or the like breaks down due to the drop off of the interposition member. Hence the magnetic field generating member with high reliability that can prevent such breakdowns is provided.

In addition, according to the present invention, the pair of wall sections in the interposition member is shaped to form an angle larger than 90 degrees against the floor part in the interposition member. Therefore, when the interposition member is press-fitted into the main body groove, without the external surface wedges, the interposition member is likely to drop off from the main body groove in a direction. However, with the external surface wedges and the larger than 90 degrees angle formed by the pair of wall sections, the external surface wedges are further strongly caught by the pair of side surfaces of the main body groove against the drop off direction so that each of these members is fixed more reliably. Therefore, drop off of the interposition member from the main body groove and positional displacements thereof can be prevented more reliably. The image development device or the like breaks down due to the drop off of the interposition member. Hence the magnetic field generating member with high reliability that can prevent such breakdowns is provided.

In addition, according to the present invention, the interposition member includes, in the internal surface of the pair of wall sections, wedge grooves of the internal surface directed from the lower end towards the upper end and shaped to form an acute angle thereof. Besides, internal surfaces of the pair of wall sections are respectively shaped to closely contact the surfaces of the long magnetic compact. By disposing the wedge grooves of the internal surface, the internal surface wedges directed from the upper end towards the lower end of the pair of wall sections are shaped. Consequently, when the long magnetic compact is press-fitted into the interposition member, without the internal surface wedges, the long magnetic compact is likely to drop off from the interposition member in a direction. However, with the internal surface wedges, the internal surface wedges are caught by the surfaces of the long magnetic compact against the drop off direction so that each of these members is fixed more reliably. Therefore, drop off of the long magnetic compact from the interposition member and positional displacements thereof can be prevented more reliably. The image development device or the like breaks down due to the drop off of the long magnetic compact. Hence the magnetic field generating member with high reliability that can prevent such breakdowns is provided.

In addition, according to the present invention, the main body groove is dovetail joint shaped in which the width of the bottom surface is larger than the width of the opening part. When the interposition member is press fitted into the main body groove, because the width of the lower surface of the interposition member is shaped to be larger than the width of the opening part of the main body groove, the interposition member is caught by the opening part of the main body groove so that the interposition member can be fastened within the main body groove to be fixed thereof. Therefore, drop off of the interposition member from the main body groove can be prevented more certainly. The image development device or the like breaks down due to the drop off of the interposition member. Hence the magnetic field generating member with high reliability that can prevent such breakdowns is provided.

In addition, according to the present invention, the interposition member is shaped using non-magnetic materials. In comparison to a case in which magnetic materials are used for the interposition member, peak magnetic flux density on the external surface of a magnetic particle support body (the magnetic particle support body corresponds to the position of the interposition member) can be heightened. Therefore, the support of the developer agent on the external surface of the magnetic particle support body becomes advantageous.

In addition, according to the present invention, the interposition member is shaped using non-magnetic materials. In comparison to a case in which magnetic materials are used for the interposition member, peak magnetic flux density on the external surface of the magnetic particle support body (the magnetic particle support body corresponds to the position of the interposition member) can be heightened so that stiffness property of the magnetic field generating member can be further heightened.

In addition, according to the present invention, by applying magnetic force (magnetic field) in a direction approximately parallel to the bottom surface of the groove of the main body part and approximately orthogonal to the axial direction of the main body part, magnetic anisotropy is provided. Therefore, a point that shifts magnetic poles of the magnetic force (pole shift point) can be generated in the vicinity of the opening part of the groove so that magnetic force at this position can be lessened. Hence the developer agent attached to the magnetic particle support body can be cut at this position so that the developer agent drops off from the external surface of the image development roller. Consequently, rotations under a state in which the developer agent is ceaselessly sticking to the external surface of the image development roller due to the magnetic particle support body can be prevented.

In addition, according to the present invention, the interposition member is press-fitted into the main body groove after the long magnetic compact is press-fitted into the concave portion of the interposition member so that the long magnetic compact is reinforced by the interposition member. Therefore, bending and damages generated to the long magnetic compact when the long magnetic compact is press-fitted into the main body groove can be prevented. Consequently, the assembly workability of the magnetic field generating member and the yield ratio of the long magnetic compact can be improved so that productivity can be heightened.

In addition, according to the present invention, the long magnetic compact is press-fitted into the concave portion of the interposition member while simultaneously the interposition member is press-fitted into the main body groove so that the long magnetic compact is reinforced by the interposition member. Therefore, bending and damages generated to the long magnetic compact when the long magnetic compact is press-fitted into the main body groove can be prevented. Consequently, the assembly workability of the magnetic field generating member and the yield ratio of the long magnetic compact can be improved so that productivity can be heightened.

In addition, the present invention includes the above-described magnetic field generating member so that a small sized magnetic particle support body can be provided.

In addition, the present invention includes the above-described magnetic particle support body so that a small sized image development device can be provided.

In addition, the present invention includes the above-described image development device so that a small sized process cartridge can be provided.

In addition, the present invention includes the above-described process cartridge so that a small sized image forming apparatus can be provided.

The above-described embodiment is only a representative embodiment of the present invention. The present invention is not limited to the above-described embodiment. That is, various modifications and changes can be made to the above embodiment within a range not deviating from the scope of the present invention.

What is claimed is:

1. A magnetic field generating member, comprising:

a main body;

a groove provided in the main body;

an interposition member configured to be fitted in the groove of the main body and including a concave portion; and a magnetic member fixed into the concave portion of the interposition member, the interposition member having a "U" character like-shape in section and being configured to be fixed in the groove provided in the main body by press-fitting, the magnetic member being a long magnetic compact and configured to be fixed into the concave portion of the interposition member by press-fitting, the groove provided in the main body including a pair of side surfaces, the pair of side surfaces having a pair of straight surfaces shaped mutually parallel in the vicinity of an opening part of the groove provided in the main body, and a pair of tapered surfaces shaped so that mutual intervals between the pair of tapered surfaces gradually narrow from lower ends of the straight surfaces towards a bottom surface of the groove provided in the main body the closer to the bottom surface, the concave portion of the interposition member including a pair of wall sections, an external surface of the pair of wall sections in the interposition member respectively coming into close contact with the pair of tapered surfaces, and an upper end of the pair of wall sections being respectively shaped to be positioned in a boundary between the straight surface and the tapered surface.

2. The magnetic field generating member according to claim 1, further comprising:

one or more wedge grooves provided on the external surface of the interposition member, wherein, the wedge groove of the external surface is directed from an upper end towards a lower end on the external surface of the pair of wall sections and shaped to form an acute angle thereof, and the external surface of the pair of wall sections is respectively shaped to closely contact the pair of side surfaces of the groove provided in the main body.

3. The magnetic field generating member, comprising:

a main body;

a grove provided in the main body;

an interposition member configured to be fitted in the groove of the main body and including a concave portion; and a magnetic member fixed into the concave portion of the interposition member, the interposition member having a "U" character like-shape in section including a pair of wall sections and being configured to be fixed in the groove provided in the main body by press-fitting, the magnetic member being a long magnetic compact and configured to be fixed into the concave portion of the interposition member by press-fitting, one or more wedge grooves being provided on the external surface of the interposition member, the wedge groove of the external surface being directed from an upper end towards a lower end on the external surface of the pair of wall sections and shaped to form an acute angle thereof, and the external surface of the pair of wall sections being respectively shaped to closely contact the pair of side surfaces of the groove provided in the main body, the pair of wall sections of the interposition member being shaped to form an angle larger than 90 degrees against a floor part of the interposition member.

4. The magnetic field generating member according to claim 1, further comprising:

one or more wedge grooves provided in an internal surface of the interposition member, wherein, the wedge groove of the internal surface is directed from the lower end towards the upper end on the internal surface of the pair of wall sections and shaped to form an acute angle thereof, and the internal surface of the pair of wall sections is respectively shaped to closely contact a surface of the long magnetic compact.

5. The magnetic field generating member according to claim 1, wherein in the groove provided in the main body, the width of the bottom surface is shaped to be larger than the width of the opening part, and when the interposition member is press-fitted into the groove provided in the main body, the width of the floor part of the interposition member is shaped to be larger than the width of the opening part of the groove provided in the main body.

6. The magnetic field generating member according to claim 1, wherein the interposition member is shaped using non magnetic materials.

7. The magnetic field generating member according to claim 6, wherein the interposition member is shaped using non magnetic metals.

8. The magnetic field generating member according to claim 1, wherein a magnetic force (magnetic field) is applied in a direction approximately parallel to the bottom surface of the groove of the main body part and approximately orthogonal to the axial direction of the main body part to provide magnetic anisotropy, and a point that shifts magnetic poles of the magnetic force (pole shift point) is generated thereby in the vicinity of the opening part of the groove.

9. A manufacturing method of a magnetic field generating member, comprising:

manufacturing the magnetic field generating member according to claim 1, and press-fitting the interposition member into the groove provided in the main body part after the magnetic member is press-fitted into the concave portion of the interposition member.

10. A manufacturing method of a magnetic field generating member, comprising:

manufacturing the magnetic field generating member according to claim 5, and press-fitting the magnetic member into the concave portion of the interposition member while simultaneously the interposition member is press-fitted into the groove provided in the main body.

11. A magnetic particle support body, comprising:

the magnetic field generating member according to claim 1, and a cylindrical shaped hollow body disposed so that the magnetic field generating member becomes an internal capsule.

12. An image development device, comprising;

the magnetic particle support body according to claim 11.

13. A process cartridge, comprising:

the image development device according to claim 12.

14. An image forming apparatus, comprising:

the process cartridge according to claim 13.

15. A manufacturing method of a magnetic field generating member, comprising:

manufacturing the magnetic field generating member according to claim 3, and press-fitting the interposition member into the groove provided in the main body part after the magnetic member is press-fitting into the concave portion of the interposition member.

16. A magnetic particle support body, comprising:

the magnetic field generating member according to claim 3, and a cylindrical shaped hollow body disposed so that the magnetic field generating member becomes an internal capsule.

* * * * *